US012546476B1

(12) United States Patent
Henderson

(10) Patent No.: US 12,546,476 B1
(45) Date of Patent: Feb. 10, 2026

(54) FIRE PIT WITH RADIAL VANES

(71) Applicant: 509 Fabrications, Inc., Post Falls, ID (US)

(72) Inventor: Patrick Dusten Henderson, Post Falls, ID (US)

(73) Assignee: 509 Fabrications, Inc., Post Falls, ID (US)

( * ) Notice: Subject to any disclaimer, the term of this patent is extended or adjusted under 35 U.S.C. 154(b) by 546 days.

(21) Appl. No.: 17/962,661

(22) Filed: Oct. 10, 2022

(51) Int. Cl.
*F24B 5/02* (2006.01)
*F23M 9/02* (2006.01)

(52) U.S. Cl.
CPC ..... *F24B 5/021* (2013.01); *F23M 9/02* (2013.01)

(58) Field of Classification Search
CPC ..... F24B 5/021; F23M 9/02; F23C 7/004
USPC ..... 126/77
See application file for complete search history.

(56) References Cited

U.S. PATENT DOCUMENTS 4,471,751 A * 9/1984 Hottenroth ..... F24C 1/02 126/77
10,746,408 B1 * 8/2020 Goin ..... F24B 5/028
10,920,987 B2 * 2/2021 Myers ..... F23B 60/02
2015/0167963 A1 * 6/2015 Chen ..... F23C 7/002 431/353
2019/0313851 A1 * 10/2019 Shemp ..... A47J 37/0718

* cited by examiner

*Primary Examiner* — Allen R. B. Schult
*Assistant Examiner* — William C Weinert
(74) *Attorney, Agent, or Firm* — Lee & Hayes, P.C.

(57) ABSTRACT

An apparatus includes a bottom, a top including an opening, a first sidewall coupled to the top and the bottom, a second sidewall coupled to the top and the bottom, an interior defined at least in part by the bottom, the top, the first sidewall, and the second sidewall, and a central vertical axis. A first vane couples to the first sidewall, within the interior, and follows a spiral trajectory about the central vertical axis in a direction between the bottom and the top. A second vane couples to the second sidewall, within the interior, and follows a spiral trajectory about the central vertical axis in the direction between the bottom and the top.

20 Claims, 18 Drawing Sheets

FIRE PIT WITH RADIAL VANES

BACKGROUND

Fire pits, or other portable combustion devices, provide heat that can be used for warmth, cooking, or general pleasure. However, in some examples, fires burning within the fire pits may provide a less than desirable experience. For example, fires may generate excessive amounts of smoke or ash. In such instances, the smoke may be irritable and may diminish experiences of nearby people.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features. The components, devices, and/or apparatuses depicted in the accompanying figures are not to scale and components within the figures may be depicted not to scale with each other.

DETAILED DESCRIPTION

Figure 1:
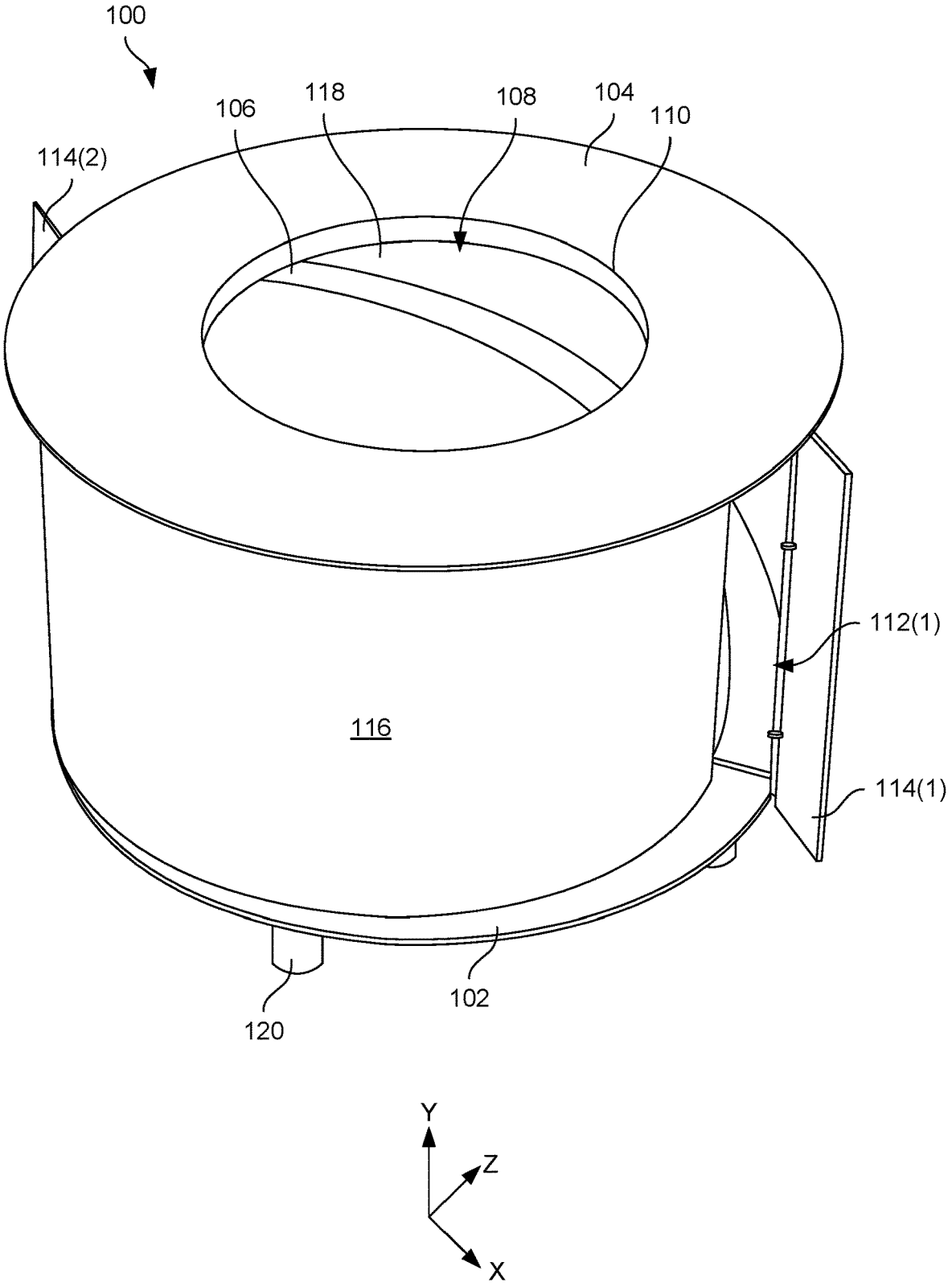
FIG. 1 illustrates a perspective view of an example fire pit, according to an example of the present disclosure.

This application is directed, at least in part, to a fire pit having radial vanes that function to reduce an amount of smoke emitted from a fire. In some instances, the fire pit has a top and a bottom, and two half-circular sections disposed between the top and the bottom. Radial vanes are formed on an interior surface of the half-circular sections, within an interior of the fire pit. The radial vanes serve to channel or otherwise direct a flow of air within the fire pit to create or otherwise impart a spiraling motion to the fire. Dampers may control an amount air into the fire pit.

The bottom provides a base for the fire pit. The half-circular sections may include a first end and a second end, with the first end being coupled to the bottom, and the second end being spaced apart from the bottom and coupled to the top. For example, the half-circular sections may couple (e.g., weld) to the bottom. A height of the half-circular sections may extend between the first end and the second end. When coupled to the bottom, the height of the two half-circular sections (e.g., between the first end and the second end) may extend in a direction transverse to the bottom. In some instances, the second end of the half-circular sections may couple to the top or may be spaced apart from the top. In some instances, an interior of the fire pit is formed within the bottom, the top, and the half-circular sections. Within the interior, wood (or other combustible materials (e.g., pellets) may be placed.

The two half-circular sections include an interior surface, which is oriented towards the interior of the fire pit, and an exterior surface that is oriented away from the fire pit (e.g., an environment of the fire pit). As such, the interior surface of the two half-circular vanes may be oriented towards or face one another. Vanes are disposed along the interior surface of the half-circular sections. In some instances, the vanes extend along the interior surface, from the first end (or proximate thereto) to the second end (or proximate thereto) of the two half-circular sections. For example, the vanes may traverse along the interior surface, from the first end to the second end. Additionally, each of the two half-circular sections may include a first side and a second side, opposite the first side. The vanes may extend from the first side to the second side, along the interior surface. In doing so, the vanes may sweep along the interior surface in a first direction (e.g., from the first end to the second end), as well as in a second direction (e.g., from the first side to the second side). The vanes may follow a spiral-like trajectory about a central vertical axis of the fire pit.

In some instances, the half-circular sections may be offset from one another to create inlets for the fire pit. For example, a first center point of a first of the half-circular sections may be offset from a second center point of a second of the half-circular sections. This offset creates inlets of the fire pit in which air is allowed to enter the interior of the fire pit. In some instances, the inlets are created between a first side of a first of the half-circular section and a second side of a second of the half-circular sections. That is, being as the interior surfaces of the two half-circular sections may face one another, a first inlet may be created between a first side of a first of the half-circular section and a second side of a second of the half-circular sections, and a second inlet may be created between a second side of the first of the half-circular sections and a first side of the second of the half-circular sections. In some instances, the fire pit may be formed via two half-circular sections coupled to the bottom. In such instances, the fire pit may include two inlets, which in some instances, may be opposed from one another on the fire pit.

In some instances, dampers may couple to the half-circular sections. The dampers may control an amount of air supplied to the interior of the fire pit, such as the amount of air taken in through the inlets. In some instances, the dampers include plates that are hingedly coupled to the bottom, the top, and/or the half-circular sections. In an open position, a flow of air into the inlets may be unrestricted. In an closed position, the flow of air into the inlets may be restricted. The dampers, however, may be adjustable between the open position and the closed position to control a supply of air. In some instances, the fire pit include two inlets and two dampers associated with each of the two inlets, respectively. The dampers may be individually controlled to permit different amounts of air to be taken in by the inlets.

The use of the vanes may control a flow of air within the interior of the fire pit. For example, given the shape and spiral nature of the vanes along the interior surface of the half-circular sections, the air may be swirled within the interior. This may create a vortex fire (or flame) that extends out of the top of the fire pit. Moreover, the top may serve to a reduce an incomplete burning of carbon-containing materials to avoid (or reduce) smoke. For example, the top may trap in heat produced by the fire to burn smoke that may otherwise be emitted from the fire. Of course, the top includes an opening through which the flame is permitted to extend.

The present disclosure provides an overall understanding of the principles of the structure, function, device, and system disclosed herein. One or more examples of the present disclosure are illustrated in the accompanying drawings. Those of ordinary skill in the art will understand that the devices and/or the systems specifically described herein and illustrated in the accompanying drawings are non-limiting embodiments. The features illustrated or described in connection with one embodiment may be combined with the features of other embodiments. Such modifications and variations are intended to be included within the scope of the appended claims.

FIG. 1 illustrates a perspective view of an example fire pit 100, according to examples of the present disclosure. The fire pit 100 is shown including a bottom 102, a top 104, and half-circular sections 116. The half-circular sections 116 are disposed between the bottom 102 and the top 104. The half-circular sections 116 may couple to the bottom 102 and/or the top 104 (e.g., fasteners, welding, etc.). In some instances, the fire pit 100 includes two half-circular sections 116, one being disposed on a first side of the fire pit 100, and another being disposed on a second side of the fire pit 100. Generally, the half-circular sections 116 represent sidewalls of the fire pit 100 (e.g., that wrap around sides of the fire pit 100).

As shown, the half-circular sections 116 extend from the bottom 102 to the top 104 (e.g., in the Y-direction). In doing so, the half-circular sections 116 may form sidewalls of the fire pit 100. Collectively, the bottom 102, the top 104, and the half-circular sections 116 may form an interior 108 of the fire pit 100. As will be explained herein, the interior 108 represents a chamber in which material (e.g., wood, pellets, etc.) is placed for burning. In some instances, the material is placed on the bottom 102 (e.g., a top surface of the bottom 102) within the interior 108. The top 104 includes an opening 110 through which a flame is permitted to extend. As such, as material is burned, the flame (and/or smoke, heat, etc.) may extend through the opening 110. In some instances, the opening 110 is centrally located on the top 104 (or the fire pit 100).

The fire pit 100 includes inlets 112 that provide access to the interior 108. In some instances, the fire pit 100 includes two inlets 112 that are opposed to one another. For example, the fire pit 100 may include a first inlet 112(1) located on a first side of the fire pit 100, and a second inlet (hidden in FIG. 1) located on a second side of the fire pit 100. The inlets 112 permit air to enter the interior 108. Additionally, the fire pit 100 may include dampers 114, such as a first damper 114(1) and a second damper 114(2), associated with the inlets 112, respectively. The dampers 114 may be hingedly coupled to the bottom 102, the top 104, and/or the half-circular sections 116. In doing so, the first damper 114(1) may control an amount of air taken in through the first inlet 112(1), and the second damper 114(2) may control an amount of air taken in through the second inlet.

In some instances, the dampers 114 may be individually controlled such that different amounts of air may be taken in through the inlets 112. The dampers 114 in FIG. 1 are shown being in an open (or semi-open) position. As shown, the dampers 114 may represent solid plates, however, other type dampers may be used (e.g., louvers). In such instances, the dampers 114 may be completely solid (e.g., no openings), or may include voids (e.g., holes, channels, etc.). Moreover, the dampers 114 may include more than one piece, where each piece (e.g., half) may be individually controlled. Additionally, the dampers 114 may include handles or other gripping elements (e.g., tabs) for opening and closing the dampers 114.

The half-circular sections 116 include vanes 106 that traverse along an interior surface 118 of the half-circular sections 116. The interior surface 118 is oriented towards the interior 108 of the fire pit 100, opposite an exterior surface of the half-circular section 116. As will be explained in detail herein, the vanes 106 may traverse along the interior surface 118 of the half-circular sections 116 in a spiral-like fashion (e.g., about the Y-axis). In other words, the vanes 106 may extend proximate to the bottom 102, along the interior surface 118 in the spiral-like fashion, to proximate the top 104. The vanes 106 assist in channeling or directing a flow of air into the interior 108 to swirl the air, and accordingly, a flame extending from the opening 110. That is, as air enters the inlets 112, the vanes 106 provides a spiral-like flow of air within the interior 108.

In some instances, a cone may be placed over the opening 110. For example, a cone-shaped structure may include a distal end and a proximal end. The proximal end may be sized to reside over the opening 110, and the distal end may include a smaller cross-sectional dimension than that of the opening 110. When in use, the cone may function to direct a flame produced within the fire pit 100. That is, the flame may extend from the opening 110, through the cone, and out another opening at the distal end of the cone. In some instances, the cross-sectional dimension of the distal end of the cone, or the opening at the distal end of the cone, may be variable to permit an adjustment of the flame (e.g., adjustable nozzle). In some instances, the proximal end of the cone may include a flange that abuts the top 104, and/or extends into the opening 110, to position the cone in place on the fire pit 100.

In some instances, feet 120 (e.g., pegs, stands, etc.) extend form the bottom 102. The feet 120 may dispose the fire pit 100 above a surface on which the fire pit 100 resides (e.g., ground). However, in some instances, the feet 120 may be omitted and the bottom 102 may rest directly on the surface. Although the fire pit 100 is shown as being generally circular-shaped, other shapes are envisioned (e.g., square). Suitable materials of the fire pit 100 may include metals, ceramics, etc., and/or any combination thereof. The fire pit 100 may be formed, or assembled, via welding, fasteners, etc. Components of the fire pit 100 may be manufactured via stamping processes, roll-forming processes, and the like. Any suitable size of the fire pit 100 is envisioned. For example, the fire pit 100 may be approximately six inches in diameter, up to four feet in diameter. Additionally, the fire pit 00 may be approximately six inches tall, or up to four feet tall. However, other dimensions are envisioned.

Figure 2:
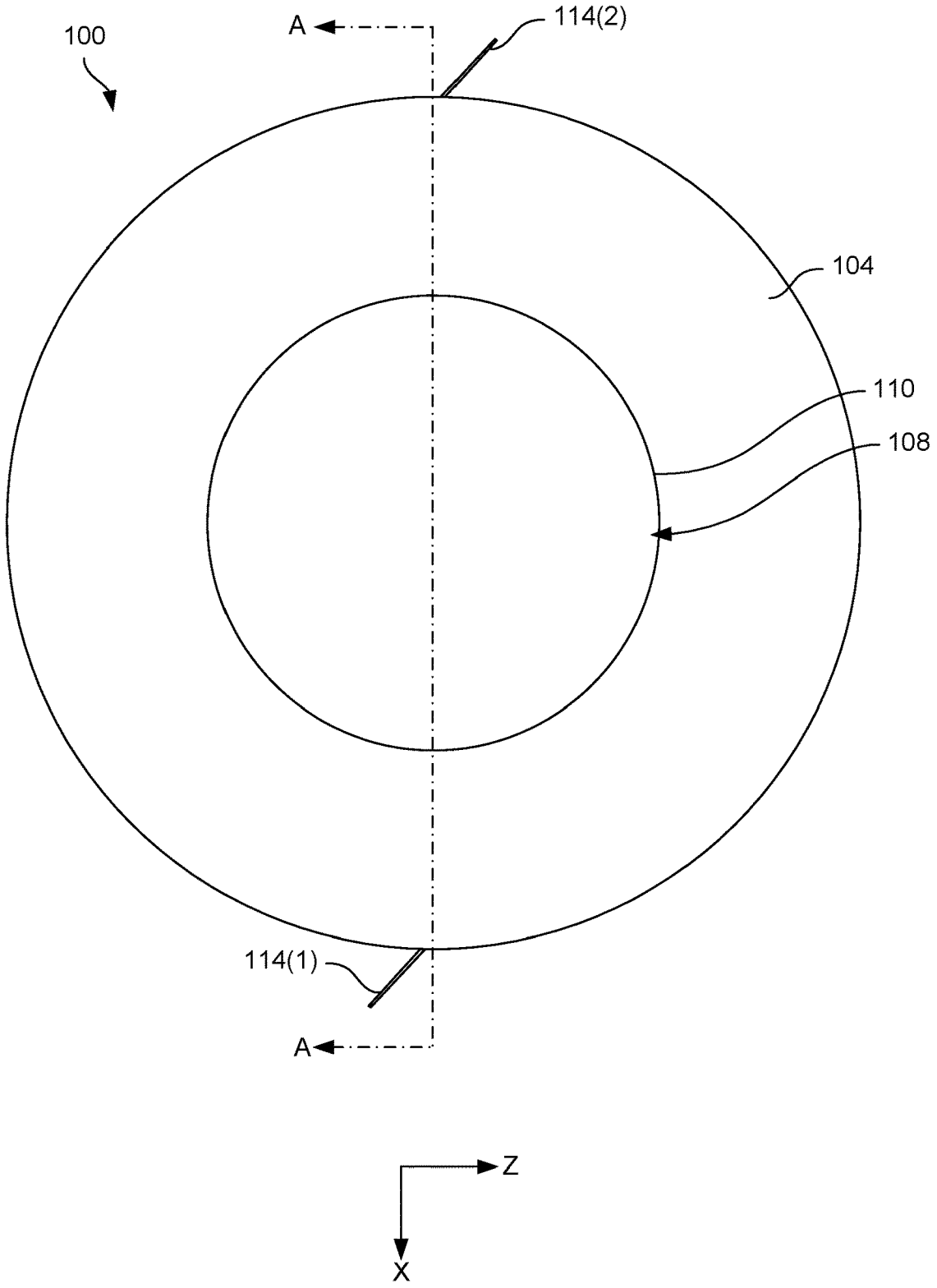
FIG. 2 illustrates a top view of the fire pit of FIG. 1, according to an example of the present disclosure.

FIG. 2 illustrates a top view of the fire pit 100, according to examples of the present disclosure. The fire pit 100 includes the top 104 and the opening 110 defined through the top 104. The fire pit 100 is shown being generally circular in shape (e.g., in the X-Z plane), however, other shapes are envisioned. Additionally, the first damper 114(1) and the second damper 114(2) are shown being in an open (or semi opened) position to permit air to enter the interior 108. A line A-A is shown extending through the fire pit 100, which is used to illustrate a cross-sectional view of the fire pit 100 in FIGS. 6 and 12.

Figure 3:
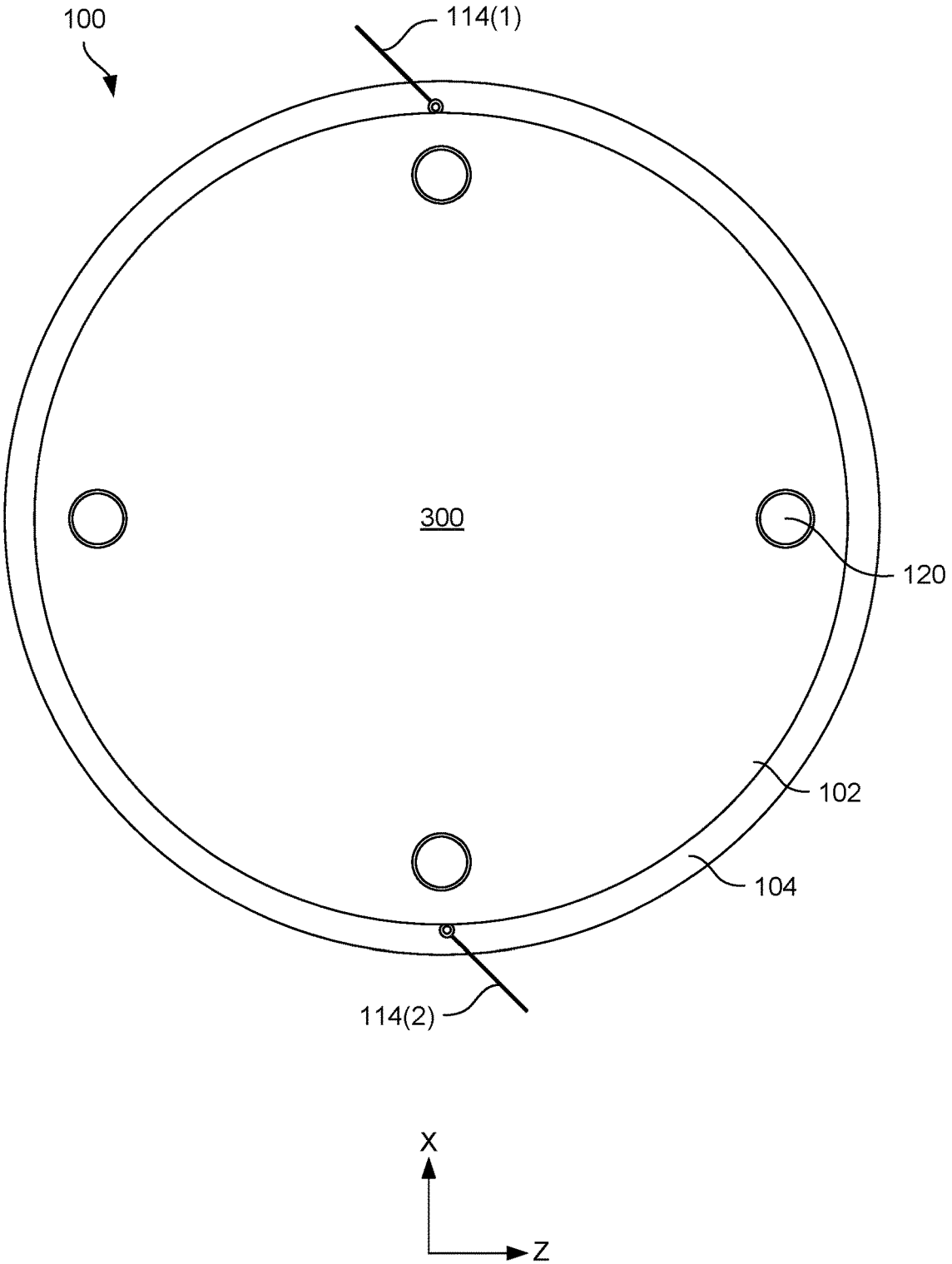
FIG. 3 illustrates a bottom view of the fire pit of FIG. 1, according to an example of the present disclosure.

FIG. 3 illustrates a bottom view of the fire pit 100, according to an example of the present disclosure. The fire pit 100 includes the top 104 and the bottom 102, which in some instances, may include the feet 120. In some instances, the feet 120 extend from a bottom surface 300 of the bottom 102. The bottom surface 300 is opposite a top surface disposed within the interior 108 of the fire pit 100, and to which the half-circular section 116 couples. The fire pit 100 is shown including circular-shaped feet that are equidistantly disposed around the bottom surface 300. Although a particular shape of the feet 120 and/or number of the feet 120 are shown, other embodiments are envisioned (e.g., more than or less than four feet, square-shaped, etc.).

In some instances, the top 104 may include a diameter (or cross-sectional dimension) that is greater than a diameter (or cross-sectional dimension) of the bottom 102. In some instances the dampers 114, when in the open position (as shown in FIG. 3), may extend beyond a periphery of the top 104. As also shown, the first damper 114(1) and the second damper 114(2) may be diametrically opposed from one another about the fire pit 100.

Figure 4:
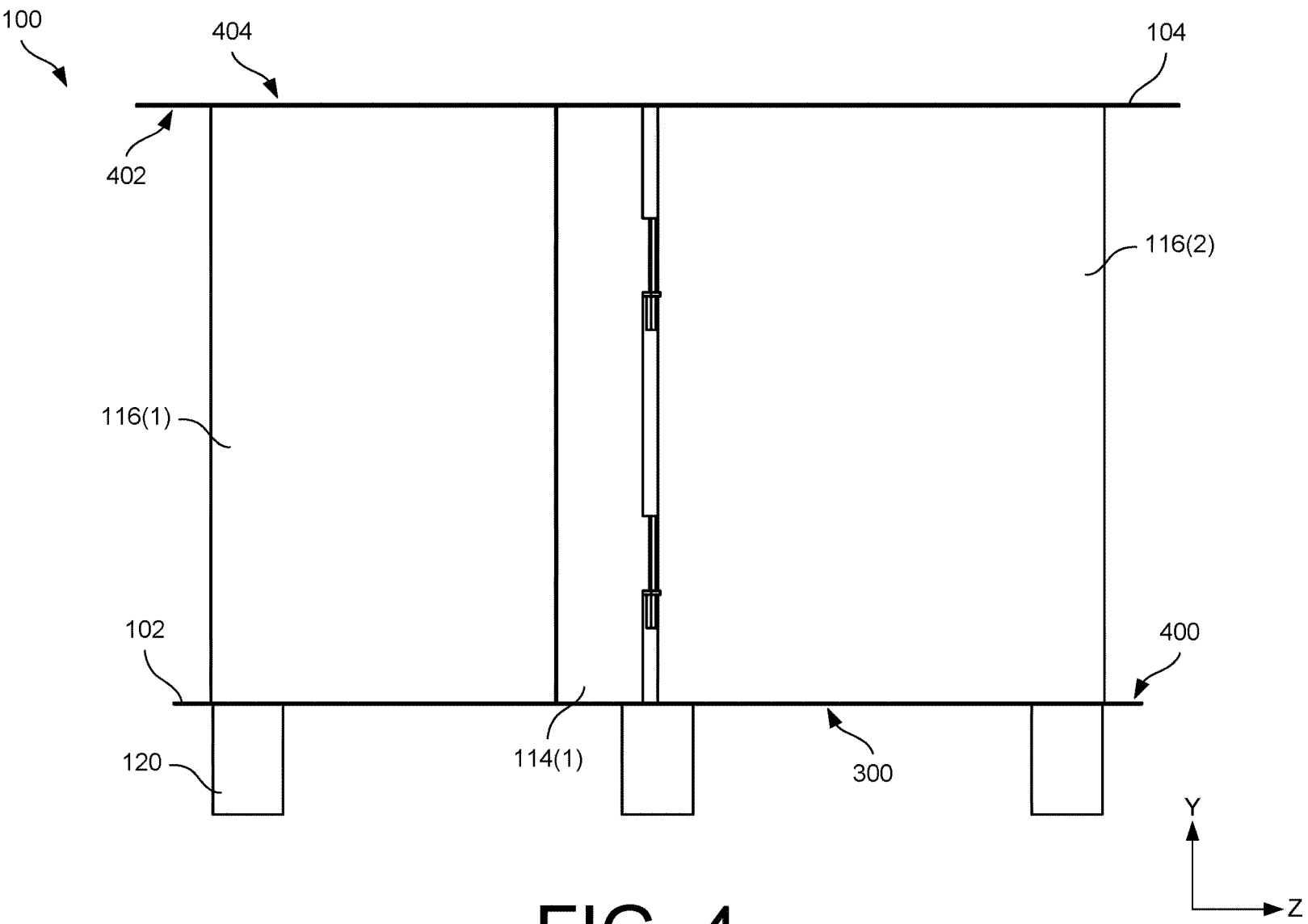
FIG. 4 illustrates a first side view of the fire pit of FIG. 1, according to an example of the present disclosure.

FIG. 4 illustrates a side view of the fire pit 100, according to an example of the present disclosure. As introduced above, the fire pit 100 may include half-circular sections 116, such as a first half-circular section 116(1) and a second half-circular section 116(2). The first half-circular section 116(1) and the second half-circular section 116(2) are shown being disposed between the bottom 102 and the top 104. The half-circular sections 116 may include a height that extends between the bottom 102 and the top 104 (e.g., in the Y-direction), thereby forming the interior 108 of the fire pit 100.

The half-circular sections 116 may couple to (e.g., weld) to the bottom 102 and/or the top 104. For example, the half-circular sections 116 may couple to a top surface 400 of the bottom 102, opposite the bottom surface 300 to which the feet 120 are coupled. Similarly, the half-circular sections 116 may couple to a bottom surface 402 of the top 104, opposite a top surface 404 of the top 104. The top surface 404 of the top 104 may represent a top surface of the fire pit 100.

The dampers 114 are disposed between the bottom 102 and the top 104. However, in some instances, the dampers 114 may not be coupled to the bottom 102 and/or the top 104 in order to permit the dampers 114 to transition between an open position and a bottom position. In some instances, the dampers 114 include a height (Y-direction) that is less than a distance interposed between the top surface 400 of the bottom 102 and the bottom surface 402 of the top 104. Moreover, given that the fire pit 100 may expand during use (e.g., via heat), sufficient tolerances may exist between the bottom 102, the top 104, and the dampers 114 to permit operation of the dampers 114.

Figure 5:
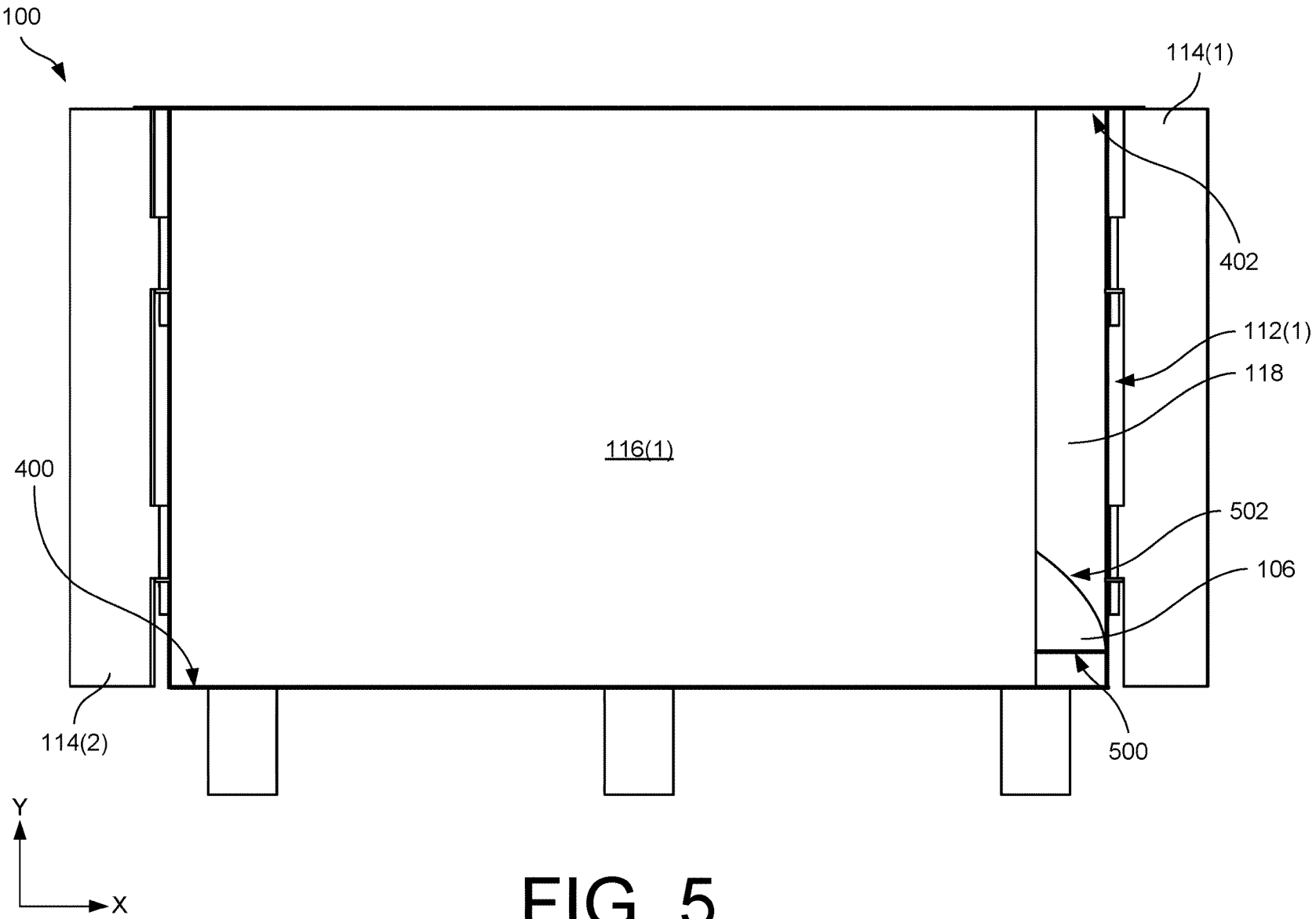
FIG. 5 illustrates a second side view of the fire pit of FIG. 1, according to an example of the present disclosure.

FIG. 5 illustrates a side view of the fire pit 100, according to an example of the present disclosure. As shown in FIG. 5, the vane 106 is disposed along the interior surface 118 of the half-circular section, such as the second half-circular section 116(2). A corresponding vane 106 extends along the interior surface 118 of the first half-circular section 116(1).

The vane 106 is disposed at the first inlet 112(1). In some instances, the vane 106 is spaced above the top surface 400 of the bottom 102, such that air may be channeled between a lower surface 500 of the vane 106 and the top surface 400 of the bottom 102. Additionally, the air is channeled between an upper surface 502 of the vane 106 and the bottom surface 402 of the top 104. As shown, the vane 106 traverses along the interior surface 118 in a spiral or helical-like fashion. That is, the vane 106 may include an upward trajectory (e.g., in the Y-direction) from the first inlet 112(1). The vane 106 also extends along the interior surface 118 about the Y-axis. The shape of the vane 106 serves to spiral the air within the interior 108 of the fire pit 100 to form a vortex a fire within with the fire pit 100.

Although not shown a vane may similarly be disposed along the interior surface of the first half-circular section 116(1). In such instances, the vane of the first half-circular section 116(1) may spiral air into the interior 108 of the fire pit 100.

Figure 6:
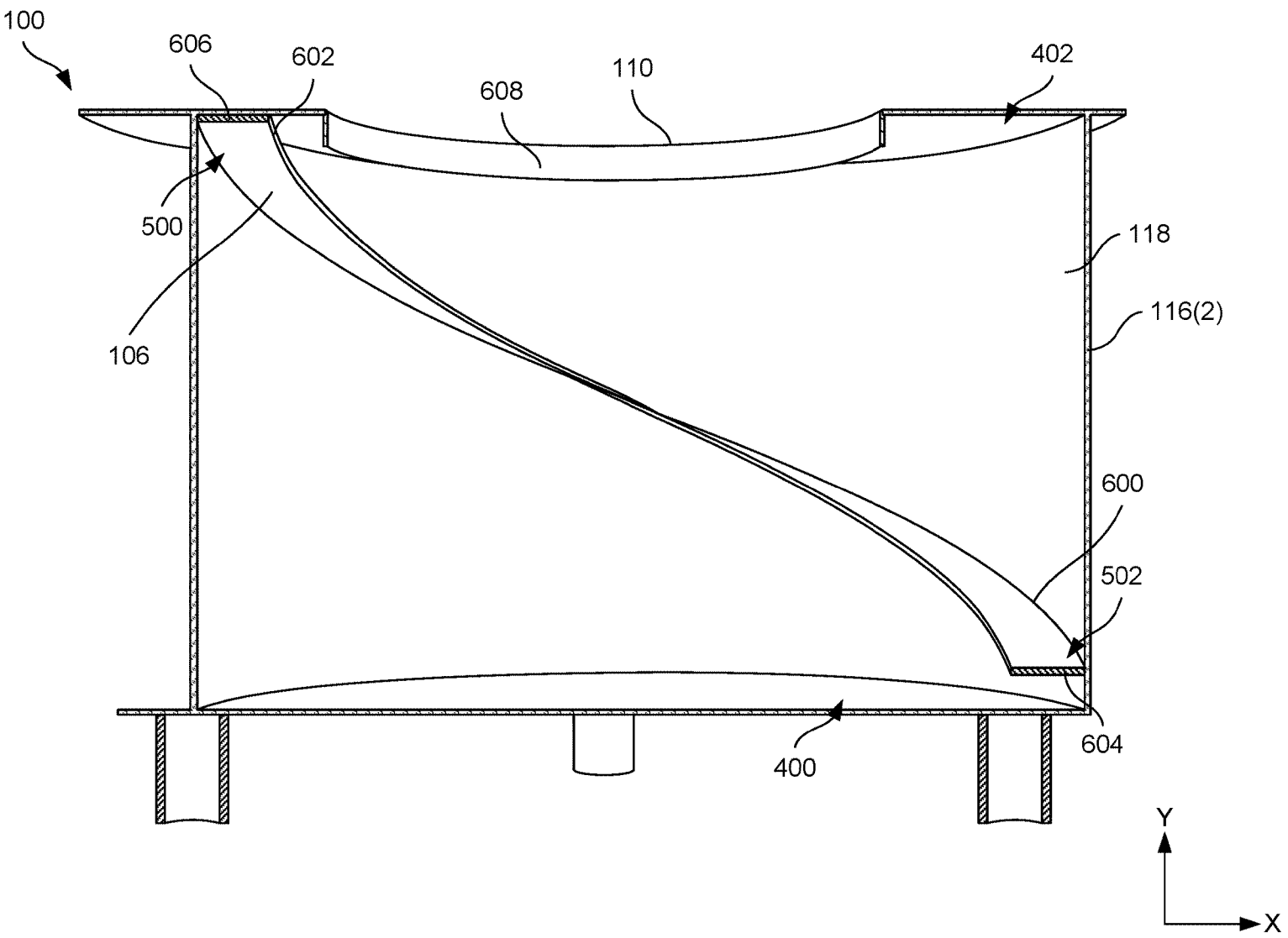
FIG. 6 illustrates a cross-section view of the fire pit of FIG. 1, taken along line A-A of FIG. 2, showing an example interior of the fire pit, according to an example of the present disclosure.

FIG. 6 illustrates a cross-sectional view of the fire pit 100, taken along line A-A of FIG. 2, according to an example of the present disclosure. The first damper 114(1) and the second damper 114(1) are shown removed to illustrate details of the vane 106.

The vane 106 includes the lower surface 500 that is oriented towards the top surface 400 of the bottom 102, and the upper surface 502 that is oriented towards the bottom surface 402 of the top 104. The vane 106 traverses along the interior surface 118. For example, the vane 106 may include an inside edge 600 that couples to the interior surface 118 (e.g., welded), and an outer edge 602 spaced apart from the inside edge 600. A thickness of the vane 106 extends between the inside edge 600 and the outer edge 602.

As the vane 106 extends along the interior surface 118, the vane 106 may also extend in a direction towards the top 104. In some instances, the vane 106 includes a first end 604 that is disposed adjacent (or proximal to) the first inlet 112(1), and a second end 606 that is spaced apart from the first end 604 along a length of the vane 106. In some instances, the vane 106 may be spaced apart from the top surface 400 of the bottom 102 at the first end 604. In doing so, air supplied via the first inlet 112(1) may be allowed to flow below and above the vane 106. That is, first air may flow under the vane 106, between the lower surface 500 and the top surface 400 of the bottom 102, and second air may flow above the vane 106, between the upper surface 502 and the bottom surface 402 of the top 104.

In some instances, the vane 106 may be coupled to the bottom surface 402 of the top 104 at the second end 606. However, in some instances, the vane 106 may be spaced apart from the bottom surface 402 of the top 104 at the second end 606 in order to create a heat cap or second burn area to assist in burning gases and helping to eliminate smoke. As will be further explained herein, given the spiraling nature of the vane 106, a distance between the lower surface 500 of the vane 106 at the first end 604 and the top surface 400 of the bottom 102 may be less than a distance between the lower surface 500 of the vane 106 at the second end 606 and the top surface 400 of the bottom 102. Similarly, a distance between the upper surface 502 of the vane 106 at the first end 604 and the bottom surface 402 of the top 104 may be greater than a distance between the upper surface 502 of the vane 106 at the second end 606 and the top surface 404 of the top 104.

The top 104 may include a flange 608 that is transverse to the top surface 404 and/or bottom surface 402 of the top 104. As shown, the flange 608 may be disposed around the opening 110. The flange 608 may extend in a direction towards the interior 108. In some instances, the top 104 and the flange 608 may serve to trap heat within an upper portion (e.g., adjacent to the top 104) of the interior 108. The heat trapped within the upper portion may effectuate to burn smoke that would otherwise be expelled through the opening 108. That is, as smoke represents, or is indicative of, unburnt carbon-containing material, having the heat trap at the upper portion of the interior 108 serves to burn off the smoke. In doing so, the fire pit 100 may be considered a smoke-less fire pit 100, or may substantially reduce an amount of smoke emitted from the fire pit 100.

Figure 7A:
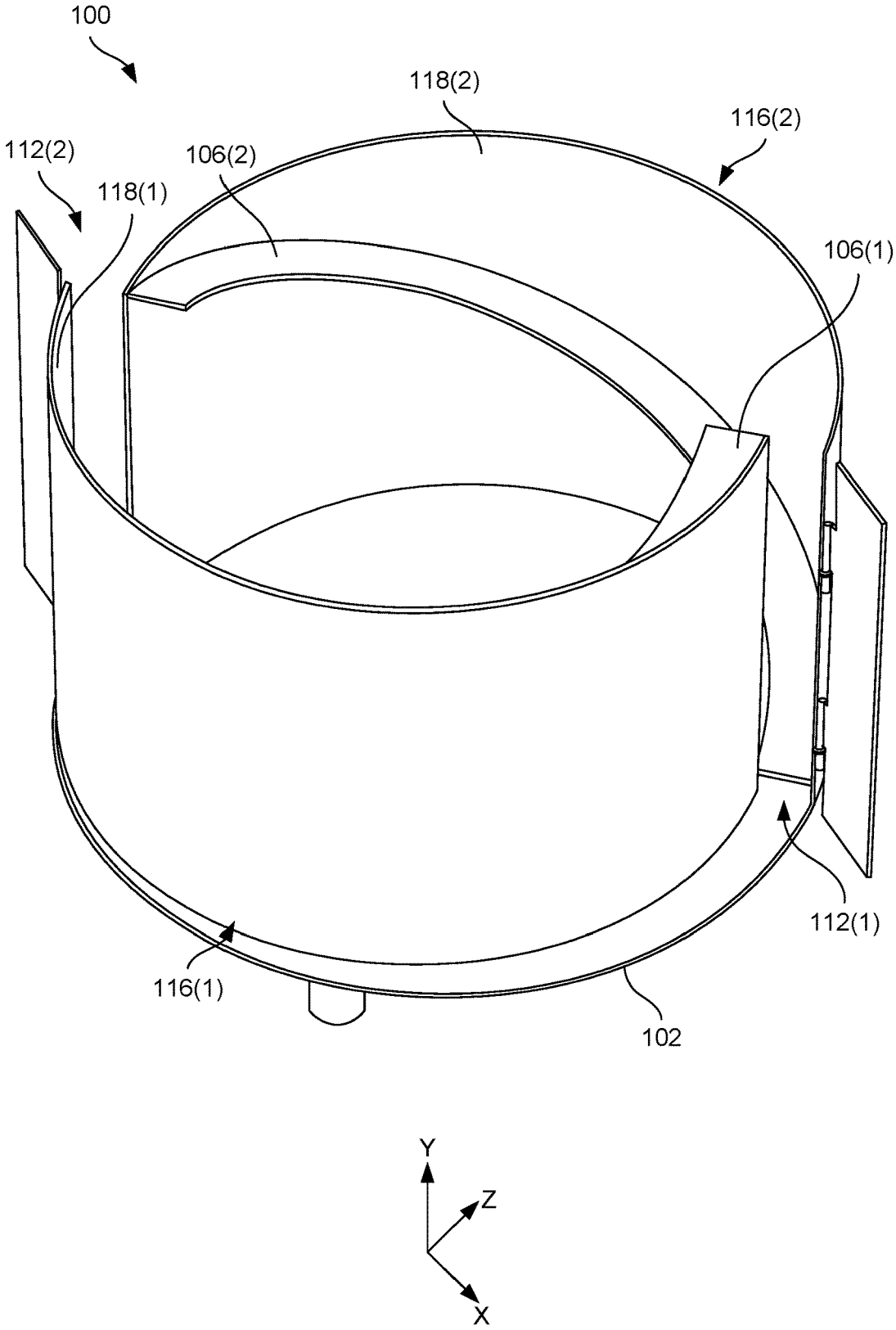
FIGS. 7A and 7B illustrate the fire pit of FIG. 1, showing a top of the fire pit removed, according to an example of the present disclosure.
Figure 7B:
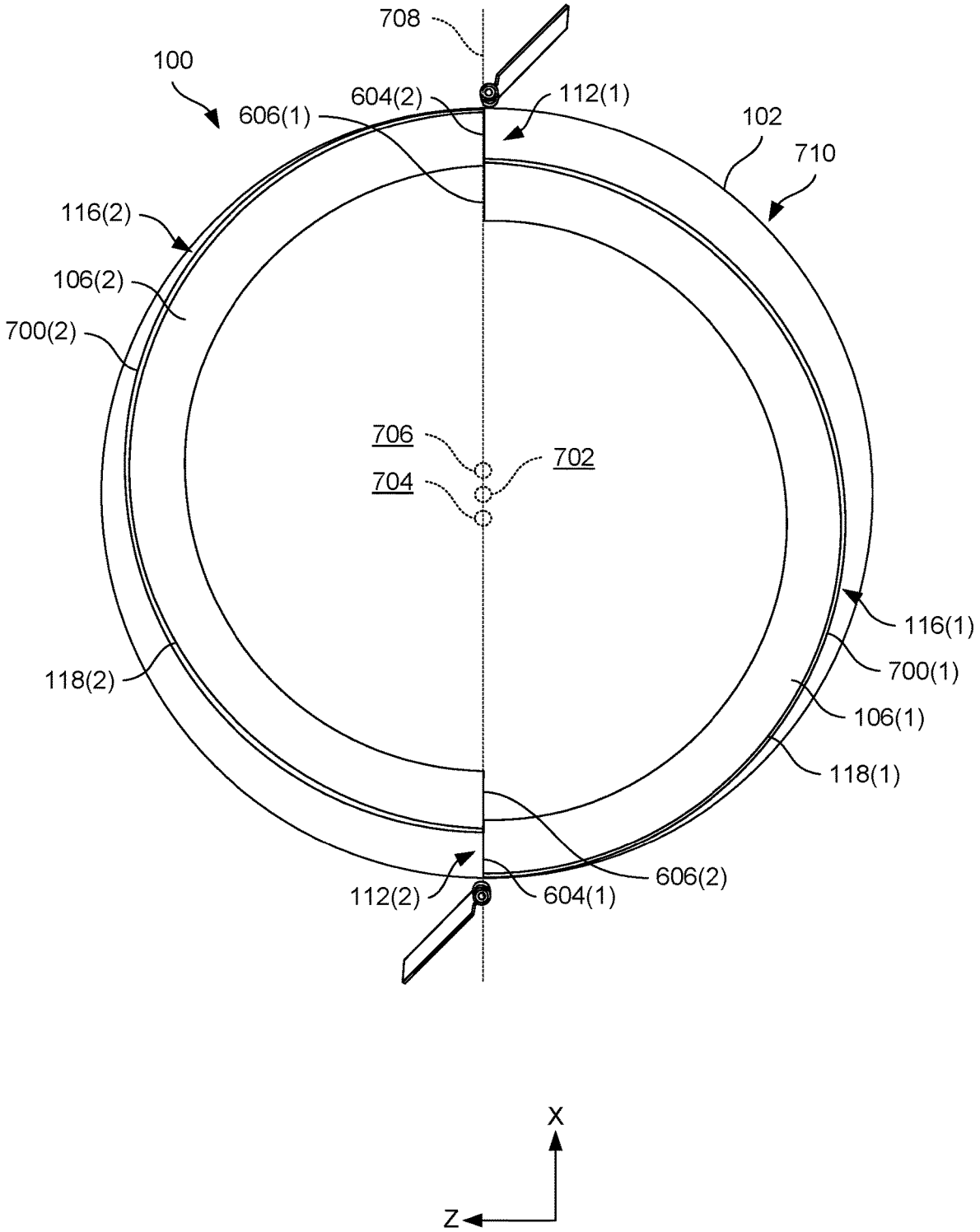

FIGS. 7A and 7B illustrate partially disassembled views of the fire pit 100 to illustrate the interior 108 of the fire pit 100, according to examples the present disclosure. More particularly, the top 104 is shown removed from the fire pit 100. FIG. 7A illustrates a perspective view of the fire pit 100, while FIG. 7B illustrates a top view of the fire pit 100.

As previously introduced, the fire pit 100 may include the first half-circular section 116(1) and the second half-circular section 116(2). In some instances, the first half-circular section 116(1) and the second half-circular section 116(2) are identical to one another. The first half-circular section 116(1) and the second half-circular section 116(2) are both shown extending from the bottom 102 (e.g., the top surface 400 of the bottom 102). Additionally, in some instances, the first damper 114(1) couples to the first half-circular section 116(1), and the second damper 114(2) couples to the second half-circular section 116(2).

As shown, a first vane 106(1) couples the interior surface 118(1) of the first half-circular section 116(1), and a second vane 106(2) couples to the interior surface 118(2) of the second half-circular section 116(2). A first end 604(1) of the first vane 106(1) is disposed proximate to the second inlet 112(2), whereas a first end 604(2) of the second vane 106(2) is disposed proximate to the first inlet 112(1). Moreover, a second end 606(1) of the first vane 106(1) is disposed proximate to the first inlet 112(1) (spaced vertically above the first end 604(2) of the second vane 106(2), whereas a second end 606(2) of the second vane 106(2) is disposed proximate to the second inlet 112(2) (spaced vertically above the first end 604(1) of the first vane 106(1).

The first half-circular section 116(1) and the second half-circular section 116(2) may be offset from one another, on or relative to the bottom 102, to form the first inlet 112(1) and the second inlet 112(2). For example, to form the first inlet 112(1), an exterior surface 700(1) of the first half-circular section 116(1) may be disposed inward from the interior surface 118(2) of the second half-circular section 116(2). Likewise, to form the second inlet 112(2), the exterior surface 700(2) of the second half-circular section 116(2) may be disposed inward from an interior surface 118(1) of the first half-circular section 116(1). More particularly, in FIG. 7B, the bottom 102 is shown including, a first center point 702, the first half-circular section 116(1) is shown including a second center point 704, and the second half-circular section 116(2) is shown including a third center point 706. The first center point 702, the second center point 704, and the third center point 706 are shown being aligned along a line 708. While the second center point 704 and the third center point 706 are disposed along the line 708, the second center point 704 is offset from the first center point 702 in a first direction, and the third center point 706 is offset from the first center point 702 in a second direction that is opposite the first direction. In doing so, even though the first half-circular section 116(1) and the second half-circular section 116(2) may be identical, the offset of the first half-circular section 116(1) and the second half-circular section 116(2) creates the first inlet 112(1) and the second inlet 112(2), respectively.

Given the offset of the first half-circular section 116(1) and the second half-circular section 116(2), certain portions of the exterior surface 700(1) of the first half-circular section 116(1) may be disposed closer to a perimeter 710 of the bottom 102 as compared to other portions of the exterior surface 700(1) of the first half-circular section 116(1). For example, proximate to the second inlet 112(2), the exterior surface 700(1) of the first half-circular section 116(1) may be disposed at, along, or proximate to the perimeter 710, whereas proximate to the first inlet 112(1), the exterior surface 700(1) of the first half-circular section 116(1) may be disposed farther away from the perimeter 710 (as compared to at the second inlet 112(2)). Similarly, proximate to the first inlet 112(1), the exterior surface 700(2) of the second half-circular section 116(2) may be disposed at, along, or proximate to the perimeter 710, whereas proximate to the second inlet 112(2), the exterior surface 700(2) of the second half-circular section 116(2) may be disposed farther away from the perimeter 710 (as compared to at the second inlet 112(2)). In some instances, the spacing of the exterior surface 700(1) and the exterior surface 700(2) away from the perimeter 710 may form a shelf at least partially around the fire pit 100.

Figure 8A:
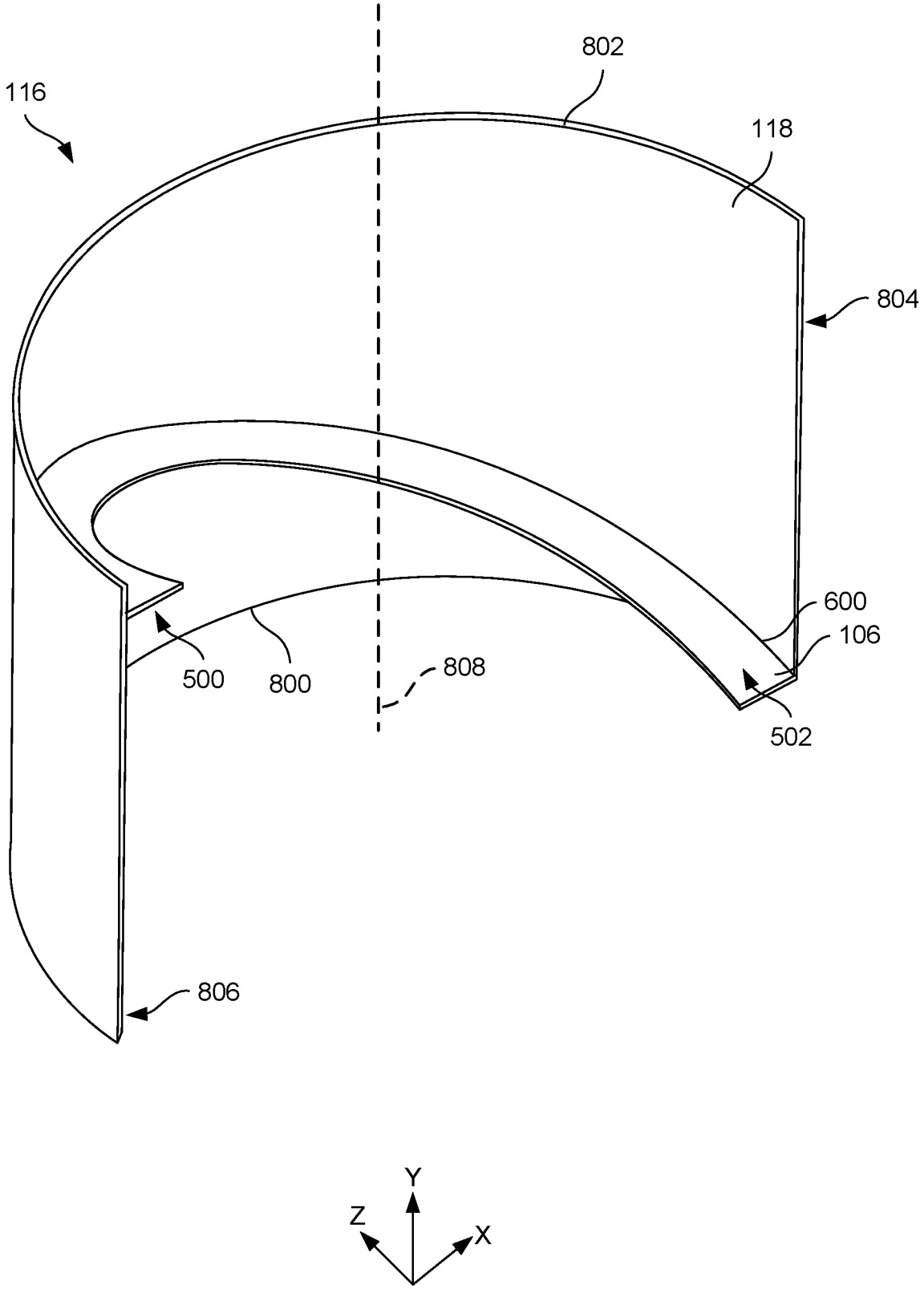
FIGS. 8A-8C illustrate a partial view of the fire pit of FIG. 1, showing a section of the fire pit with an example radial vane, according to an example of the present disclosure.
Figure 8B:
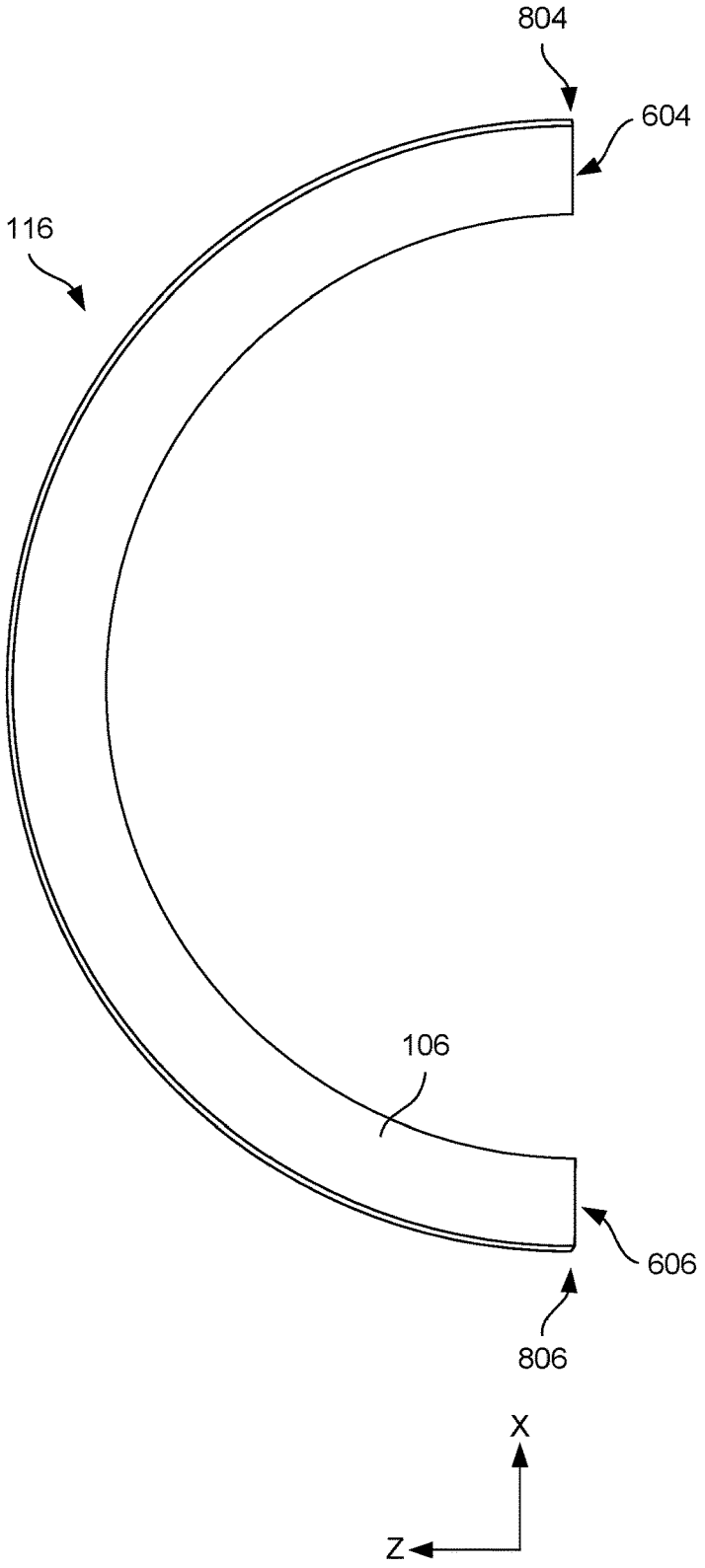
Figure 8C:
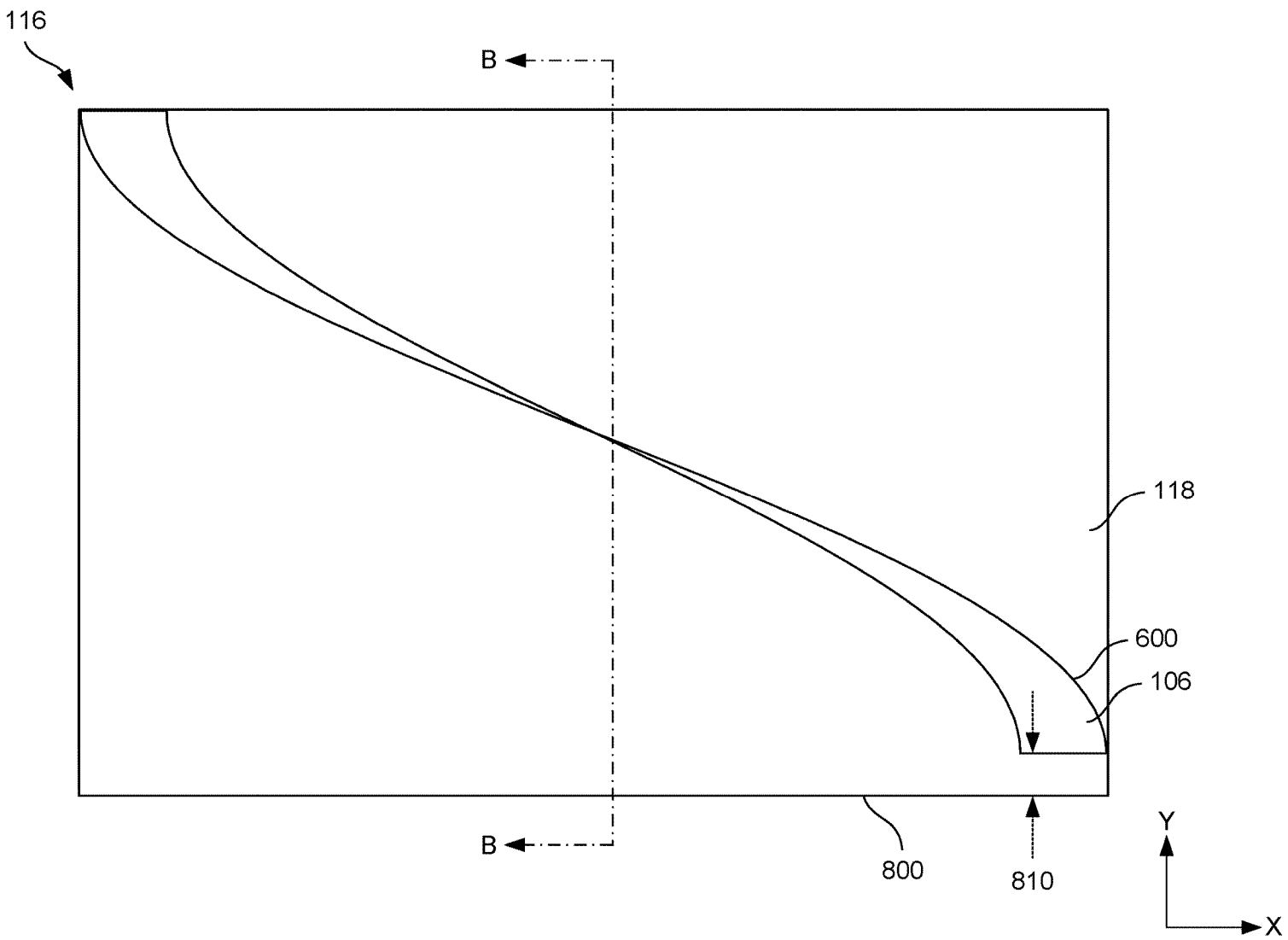

Although a particular orientation of the first half-circular section 116(1) and the second half-circular section 116(2) are shown, the first half-circular section 116(1) and/or the second half-circular section 116(2) may be disposed differently. For example, rather than producing a flame that spins clockwise about the Y-axis, the first half-circular section 116(1) and/or the second half-circular section 116(2) may be offset in different directions. More particularly, compared to the illustration in FIG. 7B, the second center point 704 may be located on an alternate side of the first center point 702, and the third center point 706 may be located on an alternate side of the first center point 702. In this example, the first vane 106(1) and the second vane 106(2) may be reconfigured such that the second end 606(1) and the second end 606(2) are disposed closer to the bottom 102 and the first end 604(1) and the first end 604(2) are disposed closer to the top 104 (e.g., the first end 604(1) and the second end 606(1) may be inversed such that the second end 606(1) becomes the first end and the first end 604(1) becomes the second end). This allows the air entering the interior 108 to travel up the first vane 106(1) and the second vane 106(2). Moreover, in this example, the flame may spin counterclockwise about the Y-axis FIGS. 8A-8C illustrate the half-circular section 116, which may be representative of the first half-circular section 116(1) and/or the second half-circular section 116(2). FIG. 8A illustrates a perspective view of the half-circular section 116, FIG. 8B illustrates a top view of the half-circular section 116, and FIG. 8C illustrates a front view of the half-circular section 116.

The half-circular section 116 may include a lower end 800 and an upper end 802. When the fire pit 100 is assembled, the lower end 800 couples to the bottom 102 and the upper end 802 couples to the top 104. A height of the half-circular section 116 extends between the lower end 800 and the upper end 802. Additionally, the half-circular section 116 includes a first side 804 and a second side 806, spaced apart from the first side 804 (e.g., in the X-direction). The first side 804 may represent one end of the half-circular section 116, whereas the second side 806 may represent an opposite end of the half-circular section 116.

The vane 106 extends along the interior surface 118, between the first end 604 and the second end 606. For example, the inside edge 600 of the vane 106 may couple to the interior surface 118. As shown, the vane 106 follows a contour of the half-circular section 116 (e.g., circular nature), but also extends in a direction between the lower end 800 of the half-circular section 116 and the upper end 802 of the half-circular section 116. In doing so, the vane 106 may extend in a circular, helical, or spiral-like fashion on the interior surface 118. That is, as the vane 106 extends in a first direction along the interior surface 118 (e.g., X-direction), the vane 106 may also extend in a second direction along the interior surface 118 (e.g., Y-direction). Stated alternatively, a central vertical axis 808 may extend through the fire pit 100, and the vane 106 may follow a helical trajectory about the central vertical axis 808, in a direction from the lower end 800 and the upper end 802 and along the interior surface 118.

In some instances, the first end 604 of the vane 106 is spaced apart from the lower end 800 by a distance 810. In some instances, the distance 810 may be between approximately 0.5 and 2.0 inches. However, other dimensions are envisioned. The distance 810 permits air to flow underneath the vane 106 (e.g., between the lower surface 500 and the top surface 400 of the bottom 102). In some instances, the second end 606 of the vane 106 may be flush with the upper end 802 of the half-circular section 116. However, in some instances, the second end 606 of the vane 106 may be spaced apart from the upper end 802 of the half-circular section 116. Additionally, in some instances, the first end 604 of the vane 106 may be planar with the first side 804 of the half-circular section 116, and/or the second end 606 of the vane 106 may be planar with the second side 806 of the half-circular section 116.

Figure 9:
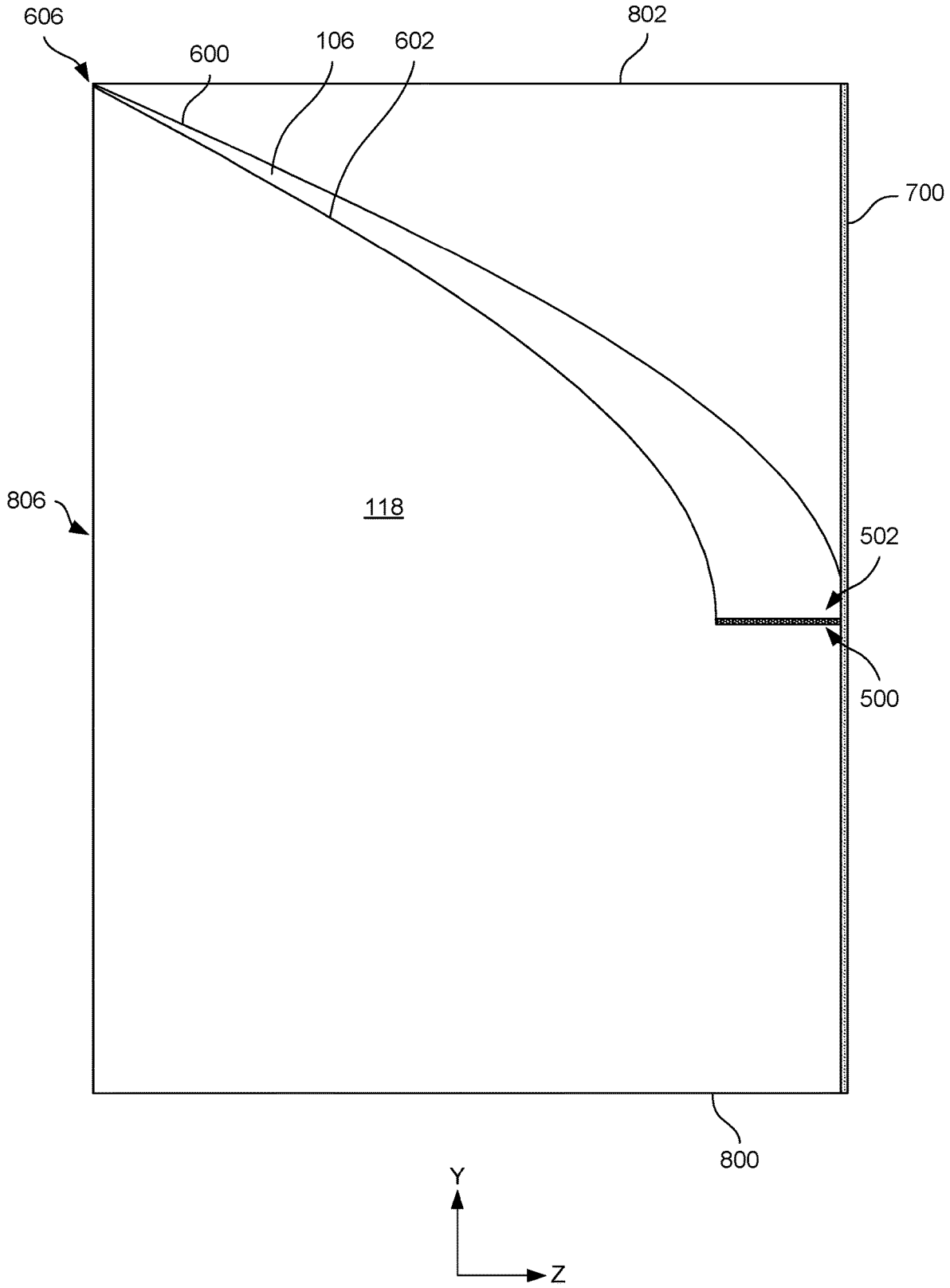
FIG. 9 illustrates a cross-sectional view the section of the fire pit of FIGS. 8A-8C taken along line B-B of FIG. 8C, according to an example of the present disclosure.

In FIG. 8C, a line B-B is illustrated taken through the half-circular section 116, which is used to illustrate a cross-sectional view of the half-circular section 116 in FIG. 9.

FIG. 9 illustrates a cross-sectional view of the half-circular section 116, taken along line B-B of FIG. 8C, according to examples of the present disclosure. The vane 106 is shown extending along the interior surface 118 of the half-circular section 116 The vane 106 is shown terminating at the second side 806 of the half-circular section 116. For example, the second end 606 of the vane 106 may terminate at the second side 806 of the half-circular section 116. Additionally, in some instances, the second end 606 of the vane 106 may terminate at the upper end 802 of the half-circular section 116. Alternatively, in some instances, the second end 606 of the vane 106 may be spaced apart from the upper end 802 of the half-circular section 116.

In some instances, the lower surface 500 and the upper surface 502 of the vane 106 is oriented orthogonal to the interior surface 118, along the length of the vane 106 (e.g., between the first end 604 and the second end 606). However, in some instances, the vane 106 or a portion of the vane 106 may be non-orthogonal to the interior surface 118.

The vane 106 couples to the interior surface 118 along the inside edge 600 of the vane 106, and the outer edge 602 is spaced apart from the inside edge 600. A width of the vane 106 extends between the inside edge 600 and the outer edge 602. In some instances, the width of the vane 106 is consistent along the length of the vane 106, between the first end 604 and the second vane 106. However, the width of the vane 106 may be variable along the length (or a portion thereof).

Figure 10A:
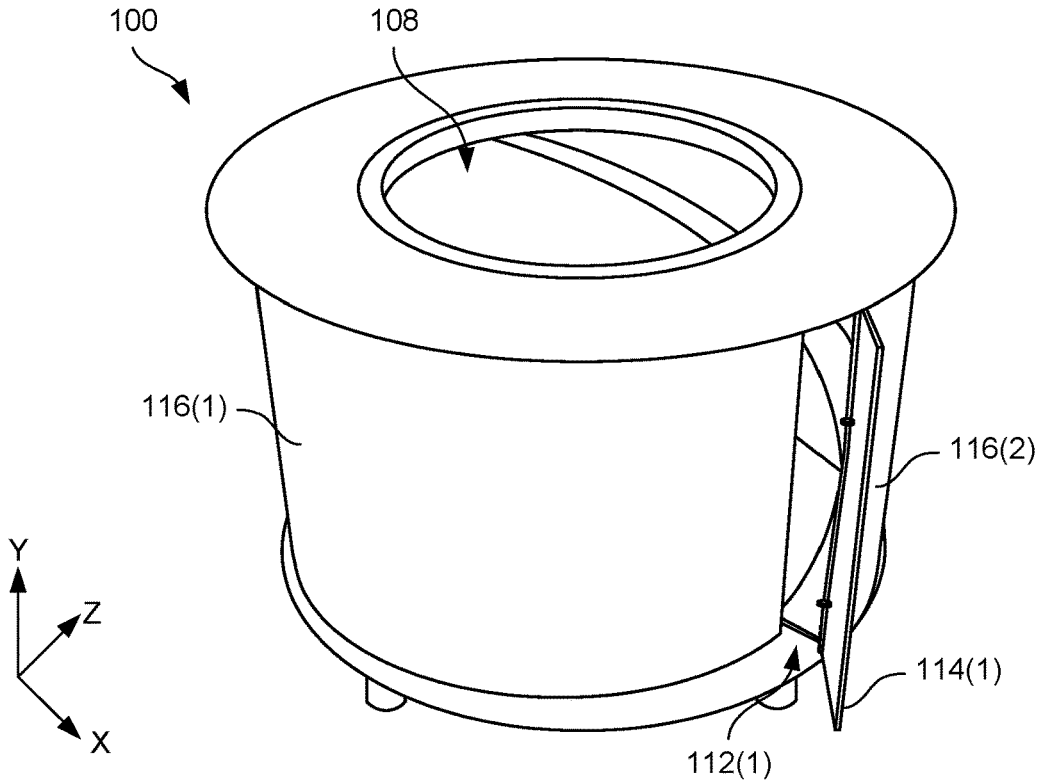
FIG. 10A illustrates example dampers of the fire pit of FIG. 1 in a first position for controlling a flow of air into an interior of the fire pit, according to an example of the present disclosure.
Figure 10B:
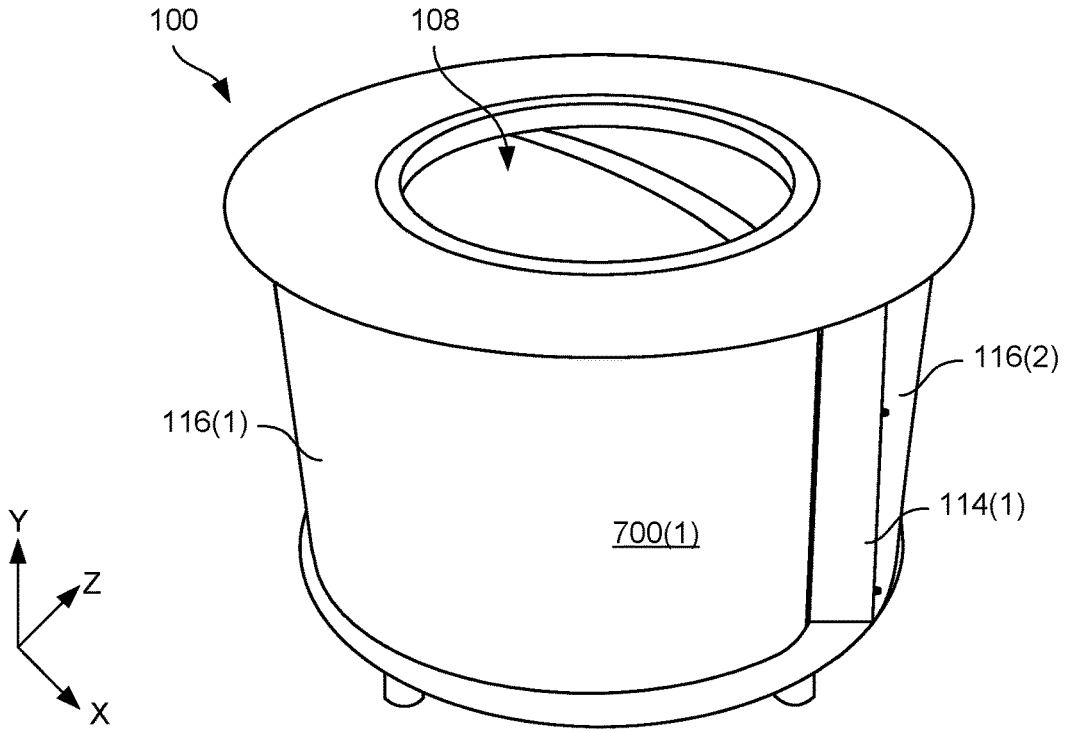
FIG. 10B illustrates example dampers of the fire pit of FIG. 1 in a second position for controlling a flow of air into an interior of the fire pit, according to an example of the present disclosure.

FIGS. 10A and 10B illustrate the operation of the dampers 114, according to examples of the present disclosure. In FIG. 10A, the dampers 114 are shown in an open position, whereas in FIG. 10B, the dampers 114 are shown in the closed position. FIGS. 10A and 10B illustrate the operation of the first damper 114(1), however, it is to be understood that the second damper 114(2) may operate in a similar manner. Moreover, the first damper 114(1) and the second damper 114(2) may operate independently of one another, such that the first damper 114(1) and the second damper 114(2) may be opened (or closed) by differing amounts.

In FIG. 10A, the first damper 114(1) is shown in an opened position. In some instances, the first damper 114(1) may rotate (e.g., swing) clockwise to the closed position, or counterclockwise in a further opened positioned. The first damper 114(1) may hingedly couple to the second half-circular section 116(2), such as at the second side 806. In the open position, air is permitted to enter the interior 108 via the first inlet 112(1).

In FIG. 10B, the first damper 114(1) is shown in a closed position. For example, from the position shown in FIG. 10A, the first damper 114(1) may rotate in a clockwise direction to the closed position. Here, the first damper 114(1) may abut, engage, or otherwise contact the exterior surface 700(1) of the first half-circular section 116(1). In doing so, air is restricted from entering the first inlet 112(1). Moreover, in the closed position, the first damper 114(1) may or may not be oriented orthogonal to the second side 806 of the second half-circular section 116(2). Given the reduced flow of air into the first inlet 112(1), the fire within the fire pit 100 may be reduced in size. In the closed position, the first damper 114(1) may seal (or substantially seal) between the exterior surface 700(1) of the first half-circular section 116(1), the top surface 400 of the bottom 102, and/or the bottom surface 402 of the top 104.

Although particular positions of the first damper 114(1) is shown, the first damper 114(1) may be placed at positions along a range of positions. For example, rather than being completely closed, the first damper 114(1) may be spaced apart (e.g., offset) from the exterior surface 700(1) of the first half-circular section 116(1). As such, a size of the first inlet 112(1), or an amount of air taken in by the first inlet 112(1), may be adjusted. Additionally, in some instances, the first inlet 112(1) and the second inlet 112(2) may be larger than shown, for example, via adjusting the offsets of the first half-circular section 116(1) and/or the second half-circular section 116(2). In such instances, the dampers 114 may be correspondingly sized to accommodate the size of the inlets 112, respectively.

Figure 11:
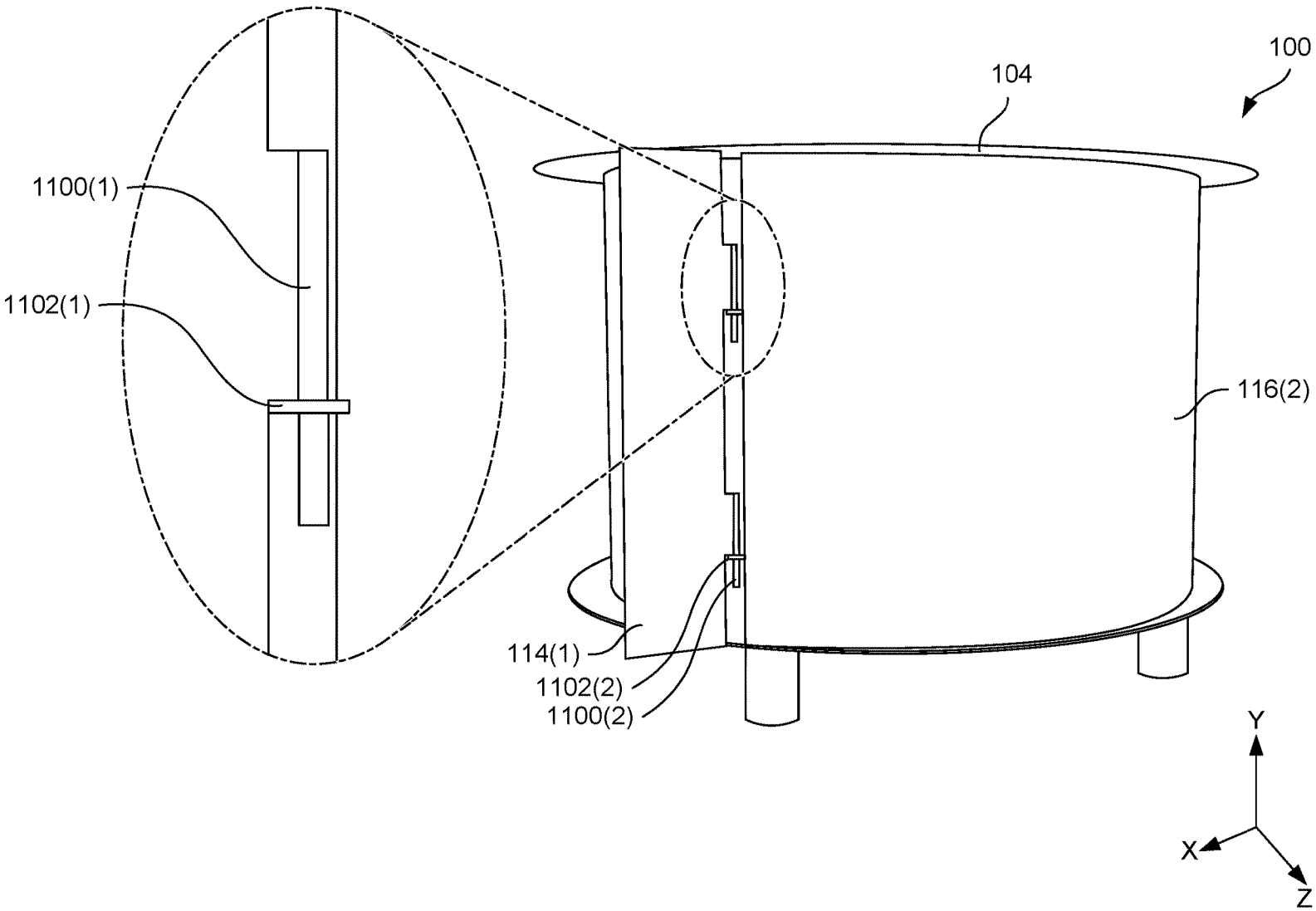
FIG. 11 illustrates an example hinged coupling of the dampers of FIGS. 10A and 10B, according to an example of the present disclosure.

FIG. 11 illustrates a hinged coupling between the dampers 114 and the half-circular section 116, according to examples of the present disclosure. FIG. 11 illustrates the operation of the first damper 114(1), however, it is to be understood that the second damper 114(2) may operate in a similar manner.

The first damper 114(1) may include two posts 1100, such as a first post 1100(1) and a second post 1100(2). The first post 1100(1) and the second post 1100(2) may extend form the first damper 114(1) or may otherwise be coupled to the first damper 114(1). The second half-circular section 116(2) may include slots 1102, such as a first slot 1102(1) and a second slot 1102(2), within which the first post 1100(1) and the second post 1100(2) engage. For example, the first slot 1102(1) may at least partially receive the first post 1100(1), while the second slot 1102(2) may at least partially receive the second post 1100(2). The coupling between the first slot 1102(1) and the first post 1100(1), as well as the second slot 1102(2) and the second post 1100(2), may resemble hinged connections. In some instances, the first slot 1102(1) and the second slot 1102(2) may be formed from washer(s) coupled to the second half-circular section 116(2) (e.g., at the second side 806).

The first post 1100(1) may be inserted into the first slot 1102(1), and/or the second post 1100(2) may be inserted into the second slot 1102(2) before a coupling of the top 104 to the half-circular sections 116. For example, the first post 1100(1) may be inserted into the first slot 1102(1) and the second post 1100(2) may be inserted into the second slot 1102(2), and thereafter, the top 104 may be secured to the half-circular sections 116.

Figure 12:
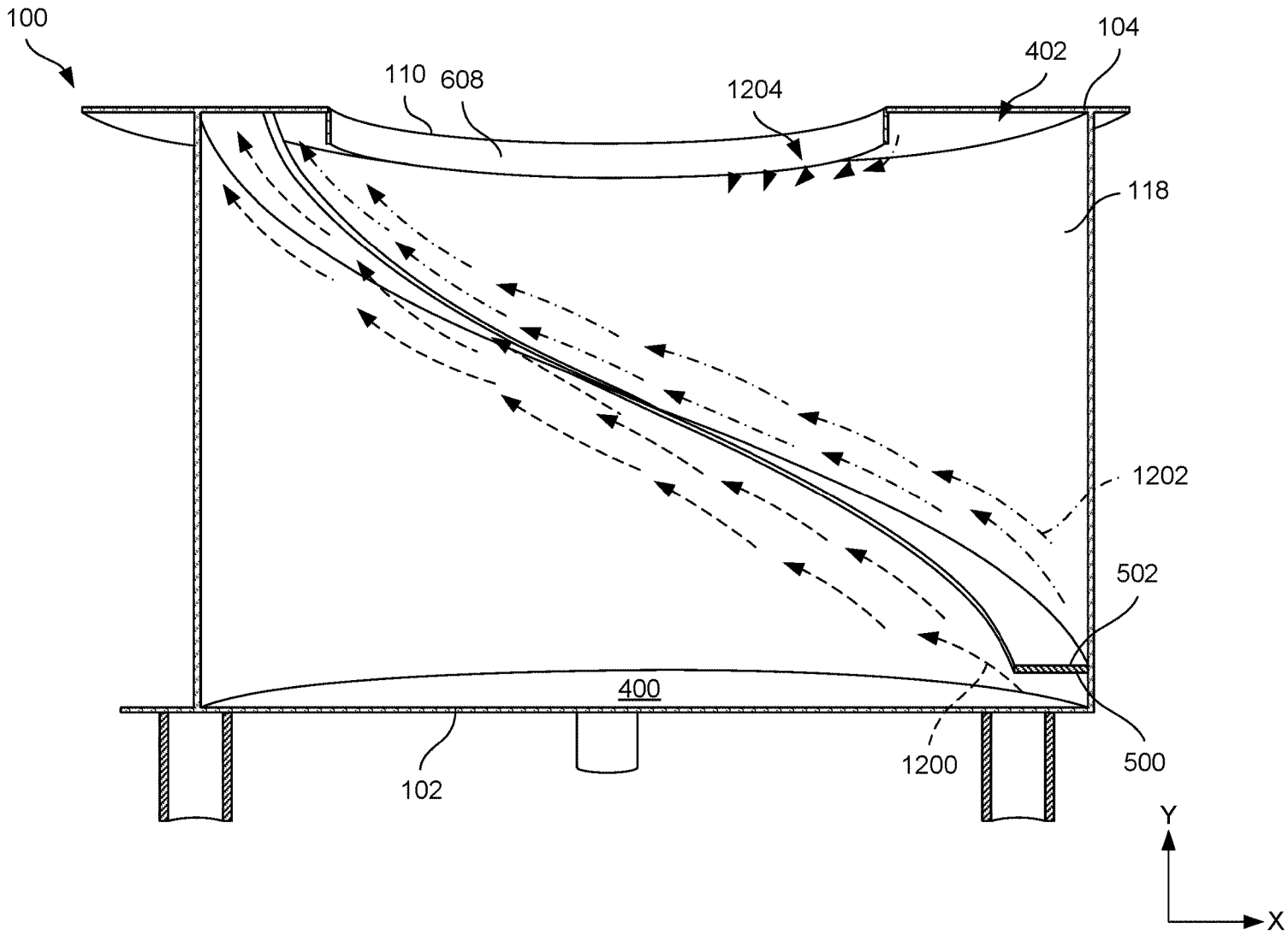
FIG. 12 illustrates an example flow of air within the fire pit of FIG. 1, take along line A-A of FIG. 2 according to an example of the present disclosure.

FIG. 12 illustrates an example flow of air within a portion of the fire pit 100, according to examples of the present disclosure. The view in FIG. 12 represents a cross-sectional view of the fire pit 100, taken along line A-A of FIG. 2, during a burning of material within the fire pit 100.

As shown, air may enter through the first inlet 112(1), for example, and flow over, and under, the vane 106. For example, first air 1200 may be routed beneath the vane 106, between the lower surface 500 of the vane 106 and the top surface 400 of the bottom 102, while second air 1202 may be routed over the vane 106, between the upper surface 502 of the vane 106 and the bottom surface 402 of the top 104. The spiral nature of the vane 106 drives the first air 1200 and the second air 1202 around the interior surface 118 to the top 104. In doing so, a swirl pattern of air is formed within the interior 108.

Moreover, hot air collects beneath the top 104. For example, as the first air 1200 and the second air 1202 are channeled towards the top 104, the first air 1200 and the second air 1202 may collect at the top 104 beneath the bottom surface 402 of the top 104. Here, third air 1204 (which may represent the first air 1200 and the second air 1202) flows under the flange 608 and out the opening 108. The third air 1204 may be hot air and may burn otherwise would be smoke emitted out of the fire pit 100. For example, the third air 1204 may burn the smoke such that the minimal smoke may be emitted from the fire pit 100. The flange 608 may assist in at least partially trapping the third air 1204 beneath the top 104 to allow the third air 1204 to pool (e.g., collect) and/or heat up to ignite the smoke.

It is to be understood that the first air 1200 and the second air 1202 may be taken in by the first inlet 112(1) as the fire within the interior 108 burns. That is, the first air 1200 and the second air 1202 may be pulled in through the first inlet 112(1). Additionally, although the discussion herein relates to the vane 106 of the second half-circular section 116(2), the vane 106 on the first half-circular section 116(1) may function similarly to route air below and above the vane 106.

Figure 13A:
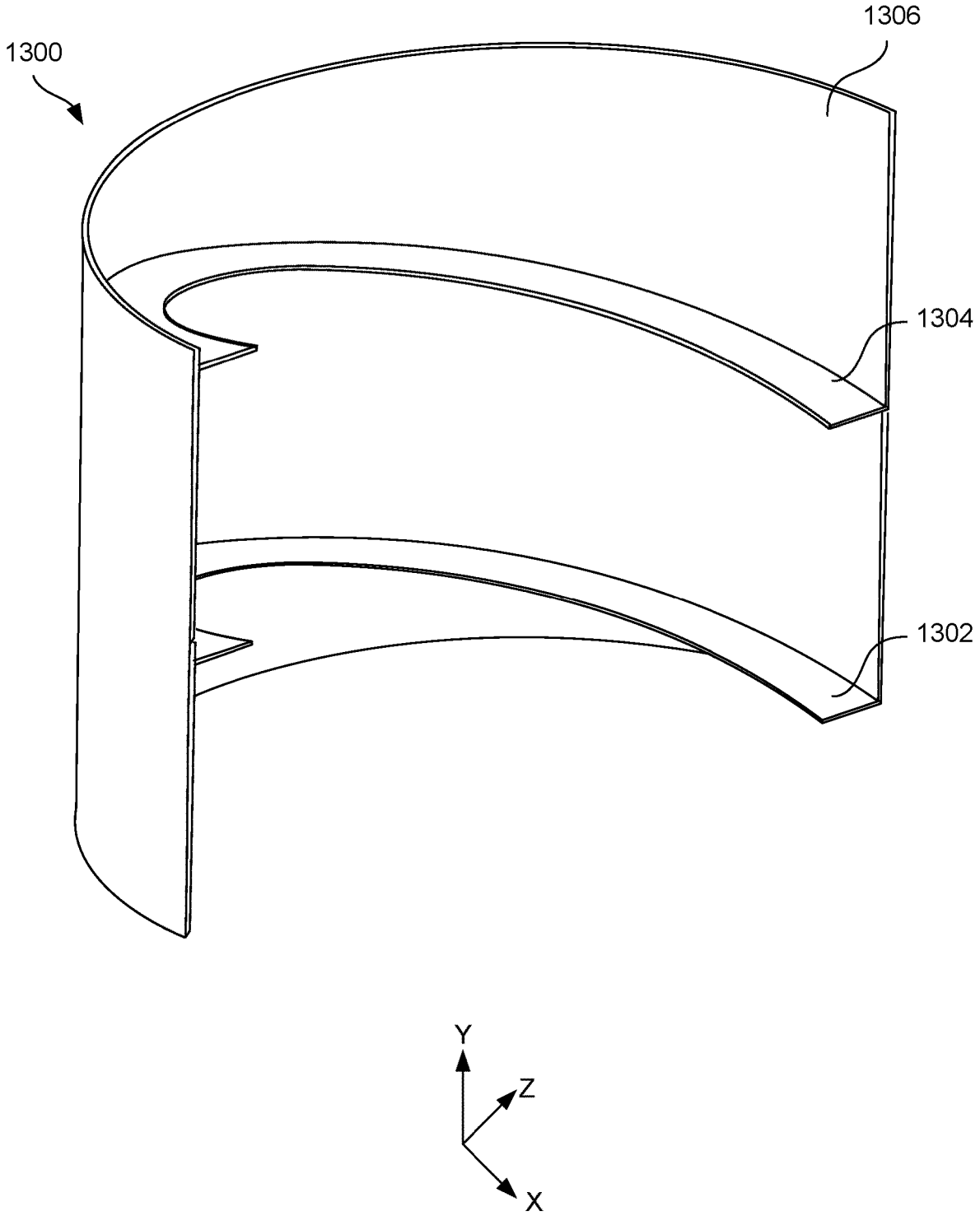
FIGS. 13A and 13B illustrate a partial view of an example fire pit, showing a section of the fire pit with multiple example radial vanes, according to an example of the present disclosure.
Figure 13B:
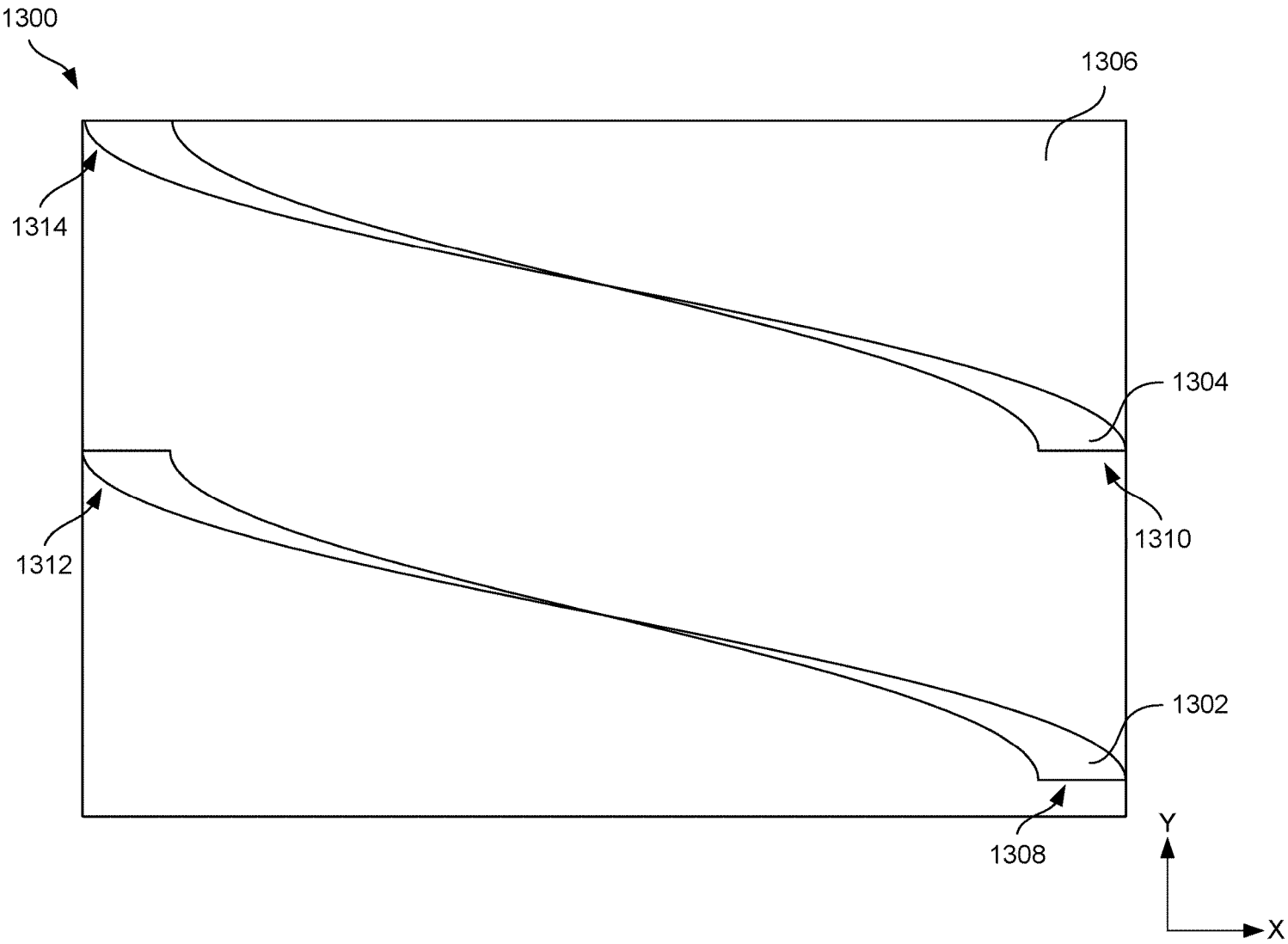

FIGS. 13A and 13B illustrate an alternative half-circular section 1300, according to examples of the present disclosure. FIG. 13A illustrates a perspective view of the half-circular section 1300, while FIG. 13B illustrates a front view of the half-circular section 1300.

The half-circular section 1300 may be similar to the first half-circular section 116(1) and/or the second half-circular section 116(2). However, as shown, the half-circular section 1300 may include two vanes, such as a first vane 1302 and a second vane 1304. The first vane 1302 and the second vane 1304 may function similarly to the vane 106 described herein. However, the use of multiple vanes may increase a swirl of air within the half-circular section 1300. The first vane 1302 and the second vane 1304 may extend along an interior surface 1306 of the half-circular section 1300.

In some instances, a height of the half-circular section 1300 may be similar to or different than the height of the first half-circular section 116(1) and/or the second half-circular section 116(2). Moreover, the first vane 1302 and/or the second vane 1304 may extend between sides of the half-circular section 1300. Further, as shown in FIG. 13B, ends of the first vane 1302 and the second vane 1304 may be aligned. For example, a first end 1308 of the first vane 1302 may be vertically aligned with a first end 1310 of the second vane 106, and/or a second end 1312 of the first vane 1302 may be vertically aligned with a second end 1314 of the second vane 106. In some instances, the second end 1312 of the first vane 1302 may be horizontally aligned with the first end 1310 of the second vane 1304. However, in some instances, the ends of the first vane 1302 and the second vane 1304 may not be aligned, respectively.

Although two vanes are shown, the half-circular section 1300, the first half-circular section 116(1), and/or the second half-circular section 116(2) may include additional vanes (e.g., three, four, etc.). In such instances, the vanes may be the same size or of a different size, whether in length and/or width. For example, the half-circular section 1300 may include three vanes. A middle vane may extend from proximate to the bottom end to proximate to the top end, while a lower vane spaced below the middle vane may be half in size (e.g., length) as the middle vane and/or an upper vane spaced above the middle vane may be half in size (e.g., length as the middle vane. As such, any number of vanes may be included, where the vanes may have different lengths, widths, trajectories, and so forth. Additionally, in some instances, the individual vanes may be formed via separate sections, which may not may not be linked together along the length of the vanes. In some instances, to accommodate the additional vanes, a height of the half-circular section 1300, the first half-circular section 116(1), and/or the second half-circular section 116(2) may be increased.

Figure 14:
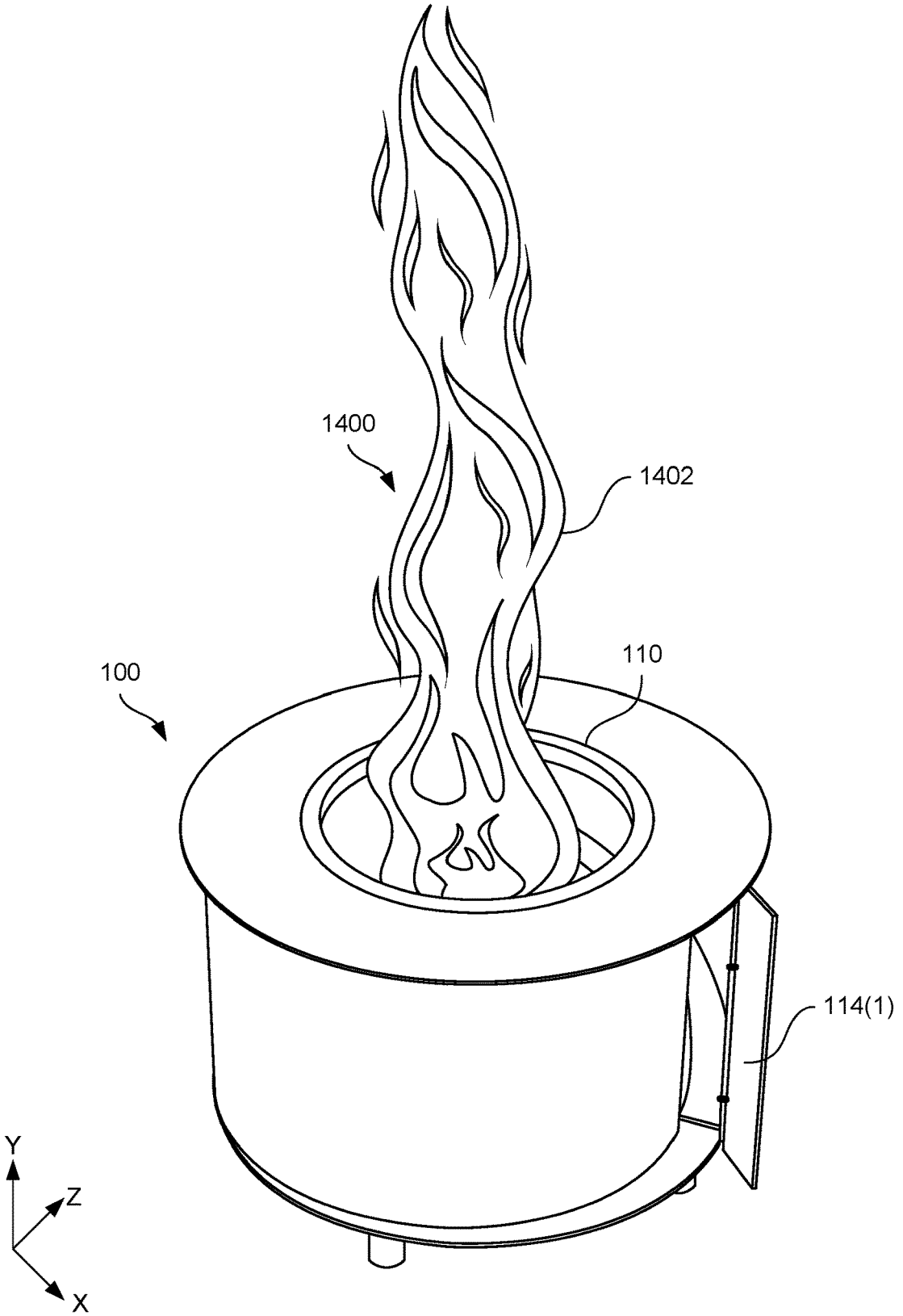
FIG. 14 illustrates an example use of the fire pit of FIG. 1, according to an example of the present disclosure.

FIG. 14 illustrates an operation of the fire pit 100, according to examples of the present disclosure. A fire 1400 is shown being burned within the fire pit 100, and a flame 1402 extending out the opening 110. The inclusion of the vanes serves to swirl the air (e.g., about the Y-axis). In doing so, the flame 1402 that extends out the opening 110 may swirl. As also shown, the first damper 114(1) is open to channel air into the interior 108 for burning by the fire 1400. Generally, the first inlet 112(1) and the second inlet 112(2) are shown being located on sides of the fire pit 100, while the opening is shown being located on a top of the fire pit 100.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A fire pit comprising:
a bottom;
a top including an opening;
a first central axis;
a first half-circular section including:
a second central axis spaced apart from the first central axis in a first direction,
a first interior surface,
a first bottom surface coupled to the bottom, and
a first top surface coupled to the top;
a second half-circular section including:
a third central axis spaced apart from the first central axis in a second direction that is opposite the first direction,
a second interior surface,
a second bottom surface coupled to the bottom, and
a second top surface coupled to the top;
a first inlet formed between the top, the bottom, the first half-circular section, and the second half-circular section; and
a second inlet formed between the top, the bottom, the first half-circular section, and the second half-circular section.

2. The fire pit of claim 1, further comprising:
a first damper hingedly coupled to the first half-circular section, the first damper being configured to adjust a first amount of air supplied to the first inlet; and
a second damper hingedly coupled to the second half-circular section, the second damper being configured to adjust a second amount of air supplied to the second inlet.

3. The fire pit of claim 1, wherein:
an interior of the fire pit is defined at least in part by the bottom, the top, the first half-circular section, and the second half-circular section;
the first inlet is fluidly connected to the interior;
the second inlet is fluidly connected to the interior; and
the opening is fluidly connected to the interior.

4. The fire pit of claim 3, wherein the top further includes a flange extending in a third direction towards the interior.

5. The fire pit of claim 1, further comprising:
a first vane that extends along the first interior surface; and
a second vane that extends along the second interior surface,
wherein:
the first half-circular section includes a first side and a second side opposite the first side;
the first vane extends between the first side and the second side;
the second half-circular section includes a third side and a fourth side opposite the third side; and
the second vane extends between the third side and the fourth side.

6. The fire pit of claim 5, wherein:
the first vane includes a first upper surface and a first lower surface;
at the first side, the first lower surface is spaced apart from the first bottom surface;
at the second side, the first upper surface is aligned with the first top surface;
the second vane includes a second upper surface and a second lower surface;
at the third side, the second lower surface is spaced apart from the second bottom surface; and
at the fourth side, the second upper surface is aligned with the second top surface.

7. The fire pit of claim 1, wherein the opening is spaced apart from the first interior surface and the second interior surface.

8. A device comprising:
a first half-circular sidewall including:
a first central axis,
a first interior surface,
a first top surface,
a first bottom surface,
a first side, and
a second side;
a second half-circular sidewall including:
a second central axis offset from the first central axis,
a second interior surface,
a second top surface,
a second bottom surface,
a third side, and
a fourth side;
a first vane extending along the first interior surface;
a second vane extending along the second interior surface;
a bottom coupled to the first bottom surface and the second bottom surface;
a top coupled to the first top surface and the second top surface;
a first inlet formed between the bottom, the top, the first side, and the third side; and
a second inlet formed between the bottom, the top, the second side, and the fourth side.

9. The device of claim 8, further comprising:
a first damper configured to adjust an intake of first air through the first inlet; and
a second damper configured to adjust an intake of second air through the second inlet.

10. The device of claim 9, wherein:
the first damper is hingedly coupled to the first half-circular sidewall or the second half-circular sidewall; and
the second damper is hingedly coupled to the first half-circular sidewall or the second half-circular sidewall.

11. The device of claim 9, wherein:
the first damper is disposed between the bottom, the top, the first side, and the third side; and
the second damper is disposed between the bottom, the top, the second side, and the fourth side.

12. The device of claim 8, wherein the first inlet and the second inlet are opposed from one another.

13. The device of claim 8, wherein:
the first vane follows a first spiral trajectory on the first interior surface; and
the second vane follows a second spiral trajectory on the second interior surface.

14. The device of claim 8, wherein:
the first vane is substantially orthogonal to the first interior surface as the first vane extends between the first bottom surface and the first top surface; and the second vane is substantially orthogonal to the second interior surface as the second vane extends between the second bottom surface and the second top surface.

15. The device of claim 8, wherein:

the top includes an opening; and a flange extends from the top.

16. The device of claim 15, wherein:

the top includes a first diameter;

the opening includes a second diameter that is smaller than the first diameter; and the flange extends around the opening.

17. An apparatus comprising:

a bottom;

a top including an opening;

a first half-circular sidewall coupled to the top and the bottom, the first half-circular sidewall having a first central axis;

a second half-circular sidewall coupled to the top and the bottom, the second half-circular sidewall having a second central axis offset from the first central axis;

an interior defined at least in part by the bottom, the top, the first half-circular sidewall, and the second half-circular sidewall;

a first vane coupled to the first half-circular sidewall, within the interior, the first vane following a spiral trajectory about the first central axis; and a second vane coupled to the second half-circular sidewall, within the interior, the second vane following a spiral trajectory about the second central axis.

18. The apparatus of claim 17, further comprising at least one of:

a third vane coupled to the first half-circular sidewall, within the interior, the third vane following a spiral trajectory about the first central axis; and a fourth vane coupled to the second half-circular sidewall, within the interior, the fourth vane following a spiral trajectory about the second central axis.

19. The apparatus of claim 17, further comprising:

a first inlet;

a second inlet;

a first damper hingedly coupled to at least one of the first half-circular sidewall or the second half-circular sidewall, the first damper being configured to control an amount of first air taken in by the first inlet; and a second damper hingedly coupled to at least one of the first half-circular sidewall or the second half-circular sidewall, the second damper being configured to control an amount of second air taken in by the second inlet.

20. The apparatus of claim 19, wherein:

the first half-circular sidewall includes:

a first side, a second side, a first bottom surface, and a first top surface;

the second half-circular sidewall includes:

a third side, a fourth side, a second bottom surface, and a second top surface;

the first inlet is defined between the second side, the third side, the top, and the bottom;

the second inlet is defined between the first side, the fourth side, the top, and the bottom;

the first bottom surface and the second bottom surface couple to the bottom;

the first top surface and the second top surface couple to the top;

the first vane extends between the first side and the second side;

a first end of the first vane is spaced apart from the bottom;

the second vane extends between the third side and the fourth side; and a second end of the second vane is spaced apart from the bottom.

* * * * *